US007089632B2

(12) United States Patent
Keyaki et al.

(10) Patent No.: US 7,089,632 B2
(45) Date of Patent: Aug. 15, 2006

(54) SLIDER FOR SLIDE FASTENER

(75) Inventors: Keiichi Keyaki, Toyama-ken (JP); Kazuo Ida, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/830,326

(22) Filed: Apr. 22, 2004

(65) Prior Publication Data

US 2004/0231115 A1 Nov. 25, 2004

(30) Foreign Application Priority Data

May 21, 2003 (JP) ..... 2003-143531

(51) Int. Cl.
*A44B 19/26* (2006.01)

(52) U.S. Cl. ..... 24/429

(58) Field of Classification Search ..... 24/429–431
See application file for complete search history.

(56) References Cited

U.S. PATENT DOCUMENTS

| | | | | |
|---|---|---|---|---|
| 2,657,445 | A | 3/1953 | Weber | |
| 4,048,699 | A * | 9/1977 | Kanzaka | 24/421 |
| 5,848,455 | A * | 12/1998 | Ikehara et al. | 24/422 |
| 6,332,249 | B1 * | 12/2001 | Oda et al. | 24/421 |

FOREIGN PATENT DOCUMENTS

| | | | |
|---|---|---|---|
| DE | 3342453 | A1 | 6/1985 |
| EP | 0365910 | A1 | 5/1990 |
| EP | 0724852 | A2 | 8/1996 |
| EP | 0804886 | A2 | 11/1997 |
| JP | 42-13148 | | 7/1967 |
| JP | 60-30201 | | 7/1985 |
| JP | 09-010019 | | 1/1997 |
| JP | 9-294612 | | 11/1997 |

* cited by examiner

*Primary Examiner*—James R. Brittain
(74) *Attorney, Agent, or Firm*—Everest Intellectual Property Law Group; Michael S. Leonard

(57) ABSTRACT

A slider for slide fastener in which locking portions formed on a front surface of a first post portion and a rear surface of a second post portion and engaging pieces formed on inner surfaces of front and rear end portions of a substantially lateral C-shaped pull holding body are elastically engaged and fixed with each other, and at the same time, the pull holding body is fitted and fixed between support walls raised at right and left end edges of the first and second post portions, so that a holding force for the pull holding body in a back and forth direction, a right and left direction, an oblique direction, and an up and down direction against a strong force by operation of a pull is increased, thereby making a structure of the slider simple and economical and achieving miniaturization of the slider.

4 Claims, 12 Drawing Sheets

SLIDER FOR SLIDE FASTENER

BACKGROUND OF THE INVENTION

1. Field of the Invention

The present invention relates to a slider for a slide fastener, and particularly, relates to a slider for a slide fastener, whereby attachment strength of a pull is improved, excellent ruggedness is realized for a long period, and an excellent assembly characteristic can be acquired.

2. Description of the Related Art

Conventionally, a slider for a slide fastener to be attached to an opening, for example, of cloths, a bag and the like is used in many cases. Basically, a slider for a slide fastener comprised three members, namely, a slider body having upper and lower blades, whose front ends are coupled by a diamond at a predetermined interval; a pull; and a pull holding body for movably and rotationally holding the pull between the pull and an upper surface of the slider body.

For example, an example of such a slider is disclosed in Japanese Patent Application Publication (JP-B) No. 60-30201. The slider disclosed in this publication is provided with hook portions at a front surface of a front post portion and a rear surface of a rear post portion, the front and rear post portions being built back and forth of the upper surface of an upper blade of the slider body; and provided with engaging pieces on inner surfaces of front and rear side wall portions of a pull holding body made of a platy cover body having a flat upper wall portion and the front and rear side wall portions. In a pull housing space portion that is formed between the opposed faces of the front and rear post portions, a pivot of the pull is movably mounted so that the hook portions and the engaging pieces are elastically engaged and fixed with each other.

The opposed faces of the front and rear post portions are respectively formed on V-shaped inclined faces that are gradually separated upward, and a tractive force from lateral and oblique sides of the pull acts with being drawn upward of the pull holding body along the V-shaped inclined face of the front post portion or the rear post portion. Therefore, the more the engaging pieces of the pull holding body pull up the hook portions of the front and rear post portions, the more the engaging pieces hold the hook portions strongly, and this makes it possible to sufficiently secure engagement of the slider body and the pull holding body.

In addition, linear concave groove portions are formed from proximal ends at sides of the hook portions of the front and rear post portions to the front and rear edges of the upper blade and at the same time, the lower surfaces of the engaging pieces of the pull holding body are formed as horizontal faces, and these horizontal faces are interiorly fit in the concave groove portions to be supported and fixed thereto. Thereby, it is possible to prevent a horizontal oscillation of the pull holding body, and further, the engaging pieces of the pull holding body and the hook portions of the front and rear post portions are reliably fitted and secured, so that it is possible to prevent the slider body and the pull holding body from being detached by the tractive force from the lateral and oblique sides of the pull.

On the other hand, as another example of the pull holding body for the slider for a slider fastener, in place of the above-described platy pull holding body for movably holding the pull, a pull holding body made of a rectangular box body having a ceiling wall portion, front and rear side wall portions, and right and left side wall portions, on which a notch is formed at its center portion, is observed.

As an example of a slider having this kind of pull holding body, for example, Japanese Utility Model Application Publication (JP-Y) No. 42-13148 that was proposed in advance by the present applicant discloses a slider, in which front and rear post portions are raised back and forth on the slider body and front ends of right and left side wall portions of the pull holding body are rotationally and externally supported by a shaft portion projecting on the right and left side walls of the front post portion against a strip-shaped elastic piece that is protruded on the front surface of the front post portion.

At rear ends of the right and left side wall portions of the box-type pull holding body covering the front and rear post portions on the slider body, pawl portions for locking the slider are formed, respectively, and the pawl portions are inserted and detached with and from a pair of right and left through holes that is formed on the upper surface of the upper blade at the rear side of the rear post portion with communicating with a coupling element guide passage in the slider body. Operating the pull that is movably disposed in the pull housing space portion between the front post portion and the rear post portion through the notch of the pull holding body, the pawl portions of the pull holding body elastically oscillate in a up and down direction around the shaft portion of the front post portion due to the function of the elastic plate of the front post portion, so that the pawl portions are engaged and disengaged between teeth of a fastener chain through the through holes at a side of the rear surface of the rear post portion.

In addition, as another example of a box-type pull holding body of a slider having such an automatic lock function, for example, Japanese Patent Application Laid-Open (JP-A) No. 9-10019 that was proposed in advance by the present applicant discloses a slider, in which a first shaft portion protruded on both right and left side wall surfaces of a base portion of an arched elastic plate is rotatably fixed and supported in the front post portion on the slider body and further, the back and forth of the right and left side wall portions of the box-type pull holding body are externally fitted to the first shaft portion of the elastic plate and the second shaft portion protruding to the right and left sides of a free end portion of the elastic plate, respectively, to be fixed and supported thereto.

Further, as another example of a box-type pull holding body of a slider, for example, JP-A-9-294612 that was proposed in advance by the present applicant discloses a slider having an automatic lock function, which is provided with hook portions at a front surface of a front post portion and a rear surface of a rear post portion that are raised back and forth of an upper blade of the slider body; and with engaging pieces to be engaged and fixed to the hook portions on an inner surface of lower ends of front and rear side wall portions of the box-type pull holding body.

According to the above-described slider disclosed in JP-B-60-30201, as described above, the pivot of the pull is movably mounted in the pull housing space portion that is formed between the front and rear post portions on the upper blade of the slider body; the hook portions protruded at a front surface of a front post portion and a rear surface of a rear post portion and the engaging pieces protruded on the inner surface of the front and rear side wall portions of the platy pull holding body are engaged and fixed; and the engaging pieces of the pull holding body are interiorly fit in and secured to the concave groove portions that are formed from proximal ends at the sides of the hook portions of the front and rear post portions of the upper blade up to the front and rear edges of the upper blade.

According to the above-described configuration, since the engaging piece of the pull holding body is elastically fitted and secured in the fitting space between the hook portion and the concave groove portion of the upper blade, if the lower end edge of the engaging portion of the pull holding body that is fitted in the concave groove is detached from this concave groove due to a large tension load in a right and left direction and an oblique direction against the flat upper wall portion of the pull holding body by the operation of the pull, the engagement of the engaging portion is also disengaged, and the pull holding body cannot return to the foregoing state, so that the pull holding body falls down from the upper blade.

As a result, in order to secure a necessary engagement force on the engaging piece of the pull holding body and the concave groove portion of the upper blade, the fitting portion fitting to the upper blade of the engaging piece of the pull holding body should be made larger, and for this, it is important that the vertical measurements of the fitting portion of the engaging piece is made larger and the depth of the concave groove portion is set deeper as much as possible. If the depth of the concave groove portion of the upper blade is made smaller than the thickness of the engaging piece to a large degree, it becomes difficult to acquire an ideal engaging force between the engaging piece and the inner wall surface of the concave groove. Accordingly, when the depth and the width of the concave groove portion of the upper blade are set smaller than the entire height of the engaging piece, even if the pull holding body and the slider body are reliably and firmly engaged, in the case where a fitting area of the engaging piece and the concave groove portion is small and a strong force occurs to release engagement of the inner wall surface of the concave groove of the upper blade and the engaging piece of the pull holding body upon moving or rotating the pull, the engaging piece of the pull holding body is easily detached from the concave groove because the holding force of the engaging piece by the concave groove against the right and left direction, or the oblique direction, or the up and down direction of the pull holding body is very small, so that this results in that the strong holding force cannot be secured only by the engagement of the engaging piece of the pull holding body and the hook portion of the upper blade.

In addition, assuming that the depth of the concave groove portion of the upper blade is deeper, in connection with this, the thickness of the upper blade should be thicker. However, in connection with setting thickness of the upper blade thicker, the outer measurement of the slider body should also be larger than the size of the concave groove portion and this inevitably involves a problem such that the slider body is made larger entirely.

Further, in connection with setting the slider body larger, the outer measurement of the pull holding body should also be larger and the size of the engaging piece of the pull holding body should be set larger by the height of the fitting space, so that this inevitably leads to make the entire slider larger. Further, in connection with the large pull holding body, the slider does not look well and this involves a problem such that its commercial value is lowered.

In the meantime, when engaging the engaging piece of the pull holding body and the hook portion of the upper blade, it is necessary to move the engaging piece by amounts for clearing a sharp end of a sliding surface of the hook portion while deforming the engaging piece in an enlarging and opening direction against an elastic force. In the case of setting the pull holding body larger as described above, since the size of its engaging piece is inevitably large, en excess pushing force is required to the hook portion of the upper blade. Since such a very large pushing force directly acts on the engaging piece and the hook portion, twist, damage, deformation and the like may easily occur at the engaging piece and the hook portion. In addition, since the elastic force of the pull holding body as the original function is missed, this involves a problem such that assembling characteristic of the slider body and the pull holding body becomes very bad, and the like.

On the other hand, as described above, the sliders disclosed in JP-Y-42-13148, JP-A-9-10019, and JP-A-9-294612 movably hold the pivot of the pull between the notches of the pull holding portion made of a rectangular box body having the ceiling wall portion, front and rear side wall portions, and right and left side wall portions on which the notches are formed at their center portions, and the upper surface of the slider body. The above-described JP-Y-42-13148 discloses the configuration such that the right and left side wall portions of the pull holding body is rotatably fitted in and supported at the shaft portion protruding to the right and left side wall surfaces of the front post portion of the slider body, the above-described JP-A-9-10019 discloses the configuration such that the right and left side wall portions on the back and forth of the pull holding body are fitted in and supported to a pair of shaft portions protruded on the back and forth of the elastic plate, and the above-described JP-A-9-294612 discloses the configuration such that the engaging pieces protruded on the inner surfaces of the lower end portions of the front and rear side wall portions of the pull holding body are fitted in and fixed to the hook portions provided on the forth surface of the front post portion and the rear surface of the rear post portion that are raised back and forth of the upper blade of the slider body.

Assuming that the tractive force of the pull is comparatively small, a lateral slip of the pull holding body may be eased up due to the right and left side wall portions of the pull holding body. However, each of the pull holding bodies disclosed in JP-Y-42-13148, JP-A-9-10019, and JP-A-9-294612 is merely fixed in any one of the right and left direction or the back and forth direction. Therefore, the holding force in any directions such as the right and left direction and the oblique direction of the pull holding body is too small to reliably and firmly assure the engagement of the slider body and the pull holding body while solely receiving the tractive force by the pull from any directions, for example, at the right and left side wall portions of the pull holding body that is miniaturized and thinned. Accordingly, the pull holding bodies disclosed in JP-Y-42-13148, JP-A-9-10019, and JP-A-9-294612 are not changed from the conventional one in that the attachment strength of the pull against the tractive force against the right and left direction or the oblique direction of the pull cannot be expected.

Thus, the technologies disclosed in the above-described respective publications have limitations in improving the attachment strength of the pull against the right and left direction or the like of the pull, so that the ruggedness cannot be secured for a long period. Therefore, the good and stable attachment strength of the pull holding body is strongly required. If this requirement is satisfied, miniaturization of the pull holding body and the slider body can be realized.

SUMMARY OF THE INVENTION

The present invention has been made taking the foregoing problems into consideration and an object of the invention is to provide a slider for a slide fastener having a simple and economic structure, which can improve an attachment strength of a pull, can secure an excellent ruggedness for a long period, further, can be miniaturized, and can realize stable and good assembly characteristic.

The basic configuration of the present invention is a slider for a slide fastener having a slider body having upper and lower blades, of which front ends are coupled by a diamond at a predetermined interval; a pull; and a pull holding body for movably holding the pull between the pull and an upper surface of the slider body, in which first and second post portions are disposed at front and rear portions of an upper surface of the upper blade, locking portions are disposed on a front surface of the first post and a rear surface of the second post, the pull holding body is composed of a platy cover body having an upper wall portion and front and rear side wall portions, and engaging portions to be elastically engaged with the locking portions of the first and second post portions are disposed on front and rear inner surfaces of the front and rear side wall portions, wherein the first and second post portions and the pull holding body further have right and left movement preventing means for preventing relative movement in a right and left direction.

As same as the conventional slider, the slider according to the present invention also comprises three members, namely, a slider body, a pull, and a pull holding body or four members, namely, the above three members and a spring body. The slider has engaging portions to be elastically engaged with locking portions that are formed on the front surface of the first post portion and the rear surface of the second post portion of the slider body. However, the slider according to the present invention is largely different from the conventional slider in that it has right and left movement preventing means for preventing relative movement in a right and left direction of the first and second post portions and the pull holding body.

As described above, in the conventional art disclosed in JP-B-60-30201, the engaging piece is fitted in and fixed to the fitting space between the hook portion and the concave groove portion of the upper blade by elastically deforming the pull holding body. Only with this configuration, if a large tension load in a right and left direction and an oblique direction is added to the pull holding body by operating the pull, as described above, due to the extremely strong tractive force acting upon the pull holding body, it is difficult to acquire a strong holding force in the right and left direction or the oblique direction or the up and down direction of the pull holding body against the engaging pieces of the pull holding body by an inner wall surface of the concave groove of the upper blade, so that it is impossible to secure a required engaging force between the engaging piece of the pull holding body and the concave groove portion of the upper blade.

According to the present invention, the locking portions of the first and second post portions and the engaging portions of the pull holding body are firmly fixed to prevent the movement in the back and forth direction of the pull holding body, and at the same time, the right and left movement preventing means can maintain the first and second post portions and the pull holding body unmoved. If a very strong force by the operation of the pull in the right and left direction to disengage the engagement between the locking portions of the first and second post portions and the engaging portions of the pull holding body, since the engagement between the locking portions of the first and second post portions and the engaging portions of the pull holding body is firm and the right and left movement preventing means is provided to prevent the relative movement not only in the back and forth direction but also in the right and left direction of the pull holding body, without bending the locking portions of the first and second post portions and the engaging portions of the pull holding body in the right and left direction or the oblique direction or the up and down direction, a holding force in the right and left direction of the pull holding body is increased so as to increase ruggedness.

In the meantime, as the locking portions of the first and second post portions to be applied to the present invention, for example, an engaging concave portion, a notch, a hole portion, a projecting portion and the like can be adopted. As the engaging portion of the pull holding body, an elastic piece, a pawl and the like to be engaged with the locking portion can be adopted. When the locking portion itself has an elastic structure, the engaging portion can be formed as a structure and a figuration such as a simple projecting portion having rigidity.

As a typical structure of the right and left movement preventing means according to the present invention, it is preferable that the right and left movement preventing means may be support walls that are raised at right and left end edges of the first and second post portions, and at least the front and rear end portions of the pull holding body are fitted and supported between the right and left support walls.

Under the state in which the locking portions of the first and second post portions and the engaging portions of the pull holding body are engaged at the front and rear end portions, at the same time, the support walls raised at the right and left end edges of the first and second post portions can firmly and reliably support and fix the pull holding body by fitting the right and left end portions of the pull holding body therein. The support wall can remarkably improve an assembly characteristic and a reliability because the support walls can integrate both the front and rear end portions of the pull holding body so that they cannot be detached from each other upon fitting and fixing them with a simple structure to fit and fix the front and rear end portions of the pull holding body. Accordingly, the pull holding body may be formed in a substantially rectangular plate piece in a simple lateral C-shaped without necessity to be formed as a complicated structure, so that miniaturization and thinning of the slider can be realized and further, the slider becomes easy to treat.

If such right and left movement preventing means is employed, the pull holding means is prevented from being laterally slipped across the support walls of the first and second post portions, and at the same time, the locking portions of the first and second post portions are firmly fixed to the engaging pieces of the pull holding body, so that it is possible to prevent the pull holding body from moving in any directions.

The right and left movement preventing means may be formed on the upper surfaces of the first and second post portions, and the opposed faces of the pull holding body against the post portions, respectively, as projecting portions or concave portions that are fitted to each other. In this case, for example, the right and left movement preventing means may be configured by the projecting portions that are formed on one of the upper surfaces of the first and second post portions and the opposed faces against the respective post portions of the pull holding body, and the concave portions that are formed on the other one of the upper surfaces of the first and second post portions and the opposed faces against the respective post portions of the pull holding body.

Without exposing a special securing structure at the outside of the slider body and the pull holding body, it is possible to sufficiently secure a secured area of the slider body and the pull holding body. Further, by setting appropriately the projecting portions and the concave portions as the right and left movement preventing means at a region where the tractive force of the pull may easily act, a holding force of the pull holding body can be firmly acquired.

It is preferable that the engaging portions of the pull holding body are made of engaging pieces to be engaged with the locking portions of the first and second post portions, and the locking portions have sliding surfaces to slide and guide the engaging pieces and elastically deform the engaging pieces and engaging stepped portions to be engaged with the engaging pieces.

By elastically deforming and pushing the engaging pieces of the pull holding body along the sliding surfaces of the first and second post portions toward the surface of the upper blade, the sharp ends of the engaging pieces pass through the front ends of the engaging stepped portions and at the same time, the engaging pieces elastically return, so that the engaging pieces and the engaging stepped portions can be engaged with each other.

Since engaging pieces, which are elastically deformable upon mounting the pull holding body, are provided, the insertion operation of the pull holding body can be smoothly and simply carried out with a small pushing force while preventing lateral slip of the pull holding body by a multi-function with the right and left movement preventing means, and it is possible to naturally and reliably engage the engaging pieces and the engaging stepped portions with each other. As a result, it is possible to prevent damage, breakage and the like of the engaging stepped portion, and further, even after attaching the pull holding body to the slider body, it is possible to prevent twist, damage and the like of the engaging pieces. Accordingly, it is possible to secure a quality of the slider for a long time.

The figuration, the setting positions, the number of elements to be set and the like of the engaging pieces are not limited to the illustrated example. On the other hand, the engaging stepped portion may be structured so as to make the engaging piece to be elastically deformed and the structure or the like of the engaging stepped portion is not particularly limited. As the engaging stepped portion, for example, various structures having the stepped portion such as the concave portion and the hole portion may be used. Accordingly, it is not necessary to form the pull holding body and slider body in a complicated structure, and miniaturization of the slider can be realized.

It is preferable that the opposed faces of a pair of right and left support walls of the first and second post portions have the stepped portions to mount and support the right and left side edge portions of the pull holding body and the stepped surfaces of stepped portions are formed along the sliding surfaces of the locking portions of the first and second post portions.

The opposed faces of a pair of right and left support walls of the first and second post portions have the stepped portions to mount and support the right and left side edge portions of the pull holding body along the both side edges in a width direction of the first and second post portions. The pair of right and left support walls secures a space portion sufficient to house the right and left side edge portions of the pull holding body through the stepped portions. Therefore, without exposing the pull holding body to the outside, the thickness of the pull holding body can be made thinner simultaneously, so that weight saving and miniaturization of the slider can be attained, and further, the slider having an excellent exterior design and a high commercial value can be obtained.

The stepped surfaces of the stepped portions are formed along the sliding surfaces of the locking portions in the first and second post portions. Therefore, the engaging portions of the pull holding body can be accurately and stably guided toward the locking portions, and further, the pull holding body can be mounted simply and in an appropriate manner.

In addition, it is preferable that right and left blade pieces each having a width between the first and second post portions are disposed on a center portion of the longitudinal direction of the pull holding body.

The engaging portions of the pull holding body are elastically engaged with the locking portions of the slider body, and further, the right and left blade pieces of the pull holding body are fit in a space portion between the rear surface of the first post portion and the front surface of the second post portion of the slider body. Therefore, upon mounting the pull holding body above the slider body, pull holding body is positioned in the back and forth direction and the width direction, so that it is possible to accurately and smoothly attach the pull holding body. In addition, under the state in which the engaging portions of the pull holding body and the locking portions of the slider body are engaged with each other, a space formed between the right and left blade pieces of the pull holding body and the upper surface of the slider body becomes an operational space portion for allowing the operation of the pivot of the pull. As a result, the pivot of the pull can be reliably held and a quality of the slider can be secured for a long time.

Further, it is preferable that cut-out portions are formed on a part of the body adjacent to proximal end portions at elongation sides of the right and left blade pieces, and small projections fitted to the cut-out portions are formed at the outside end portions of the stepped portions of the first and second stepped portions.

The engaging pieces of the pull holding body are elastically engaged with the locking portions of the slider body, the right and left blade pieces of the pull holding body are fitted in the space portion between the rear surface of the first post portion and the front surface of the second post portion of the slider body, and the cut-out portions of the pull holding body are fitted in and engaged with the small projections of the slider body. Therefore, after mounting the pull holding body, the pull holding body can be firmly and reliably attached without oscillating against any forces in the back and forth direction and in the width direction.

In addition, the second basic configuration of the present invention is a slider for a slide fastener having a slider body having upper and lower blades, of which front ends are coupled by a diamond at a predetermined interval; a pull; and a pull holding body for movably holding the pull between the upper surface of the slider body and the pull holding body, in which first and second post portions are disposed at front and rear portions of the upper surface of the upper blade, the pull holding body comprises a ceiling wall portion, and first and second engaging portions having front and rear side wall portions and right and left side wall portions on which notches are formed at their center portions, the pull holding body is made of a rectangular box of which lower surface is open, and has first engaging pieces on the inner surfaces of the front and rear side wall portions and second engaging pieces orthogonally intersecting with the first engaging pieces on the inner surfaces of the right and left side wall portions, and the first and second post portions have first locking portions to be engaged with the first engaging pieces and second locking portions to be engaged with the second engaging pieces of the pull holding body.

As same as the conventional slider, the slider according to the present invention also comprises the pull holding body made of a rectangular box of which lower surface is open, and the first and second post portions of the slider body; and has the first engaging pieces on the inner surfaces of the front and rear side wall portions of the pull holding body and the first locking portions to be engaged with the first engaging pieces at the first and second post portions. However, the slider according to the present invention is largely different from the conventional slider in that it has the second engaging pieces orthogonally intersecting with the first engaging pieces on the inner surfaces of the right and left side wall portions of the pull holding body, and the second locking portions to be engaged with the second engaging pieces of the pull holding body at the first and second post portions.

Upon fitting the pull holding body, only by pushing the first and second engaging pieces of the pull holding body toward the first and second locking portions of the first and second post portions, on the basis of the notches, the front and rear side wall portions are elastically deformed in an enlarged and opened direction and at the same time, the sharp ends of the first and second engaging pieces pass through the front ends of the first and second locking portions, while elastically deforming the right and left side wall portions in the enlarged and opened direction. Then, at the same time, the first and second engaging pieces elastically return, and the first and second engaging pieces and the first and second locking portions are engaged with each other.

Under the state in which the respective engaging pieces of the pull holding body and the respective locking portions of the slider body are engaged with each other, the pull holding body seals the first and second post portions so as to completely house them therein. Accordingly, it is possible to effectively use the inside of the pull holding body and the upper surface of the slider body, so that the excellent exterior design commensurate with the exterior figuration of the slider body can be obtained and a commercial value of the slider can be sufficiently improved.

It is preferable that the first and second engaging portions of the pull holding body have engaging pieces to be engaged with the first and second locking portions of the first and second post portions, and the first and second locking portions have sliding surfaces to slide and guide the first and second engaging portions and elastically deform these engaging portions and engaging stepped portions to be engaged with the first and second engaging pieces.

Pushing the first and second engaging pieces of the pull holding body along the sliding surfaces of the first and second sliding surfaces of the first and second locking portions in the first and second post portions, the first engaging portion is elastically deformed by the first sliding surface, and together with the first engaging portion, the second engaging portion is elastically deformed by the second sliding surface. The first and second engaging pieces pass through the front end engaging portions of the first and second sliding surfaces and at the same time, the first and second engaging portions elastically return, the first and second engaging stepped portions of the first and second locking portions are automatically engaged with the first and second engaging pieces. Under this engaged state, the pull holding body and the slider body are maintained to be engaged with each other, so that it is possible to prevent the lateral slip of the pull holding body due to the tractive power of the pull. Thus, a simple structure having the sliding surfaces to slide and guide the first and second engaging portions and deform them elastically, and the engaging stepped portions to be engaged with the first and second engaging pieces can be made, so that it is possible to reliably realize miniaturization of an edging and fixing tool.

In the first and second engaging pieces, the figurations, the setting positions, the number of elements to be set and the like are not particularly limited. On the other hand, the first and second locking portions may be structured so that they can elastically deform the first and second engaging portions and they are engaged and disengaged with and from the front end engaging portions of the first and second engaging pieces, and the structures of these first and second engaging pieces are not particularly limited. As the first and second locking portions, for example, various structures having the stepped portion such as the engaging concave portion, the hole portion, and the pawl portion can be adopted.

DESCRIPTION OF THE PREFERRED EMBODIMENTS

Preferred embodiments of the present invention will be specifically described with reference to the drawings below.

Figure 1:
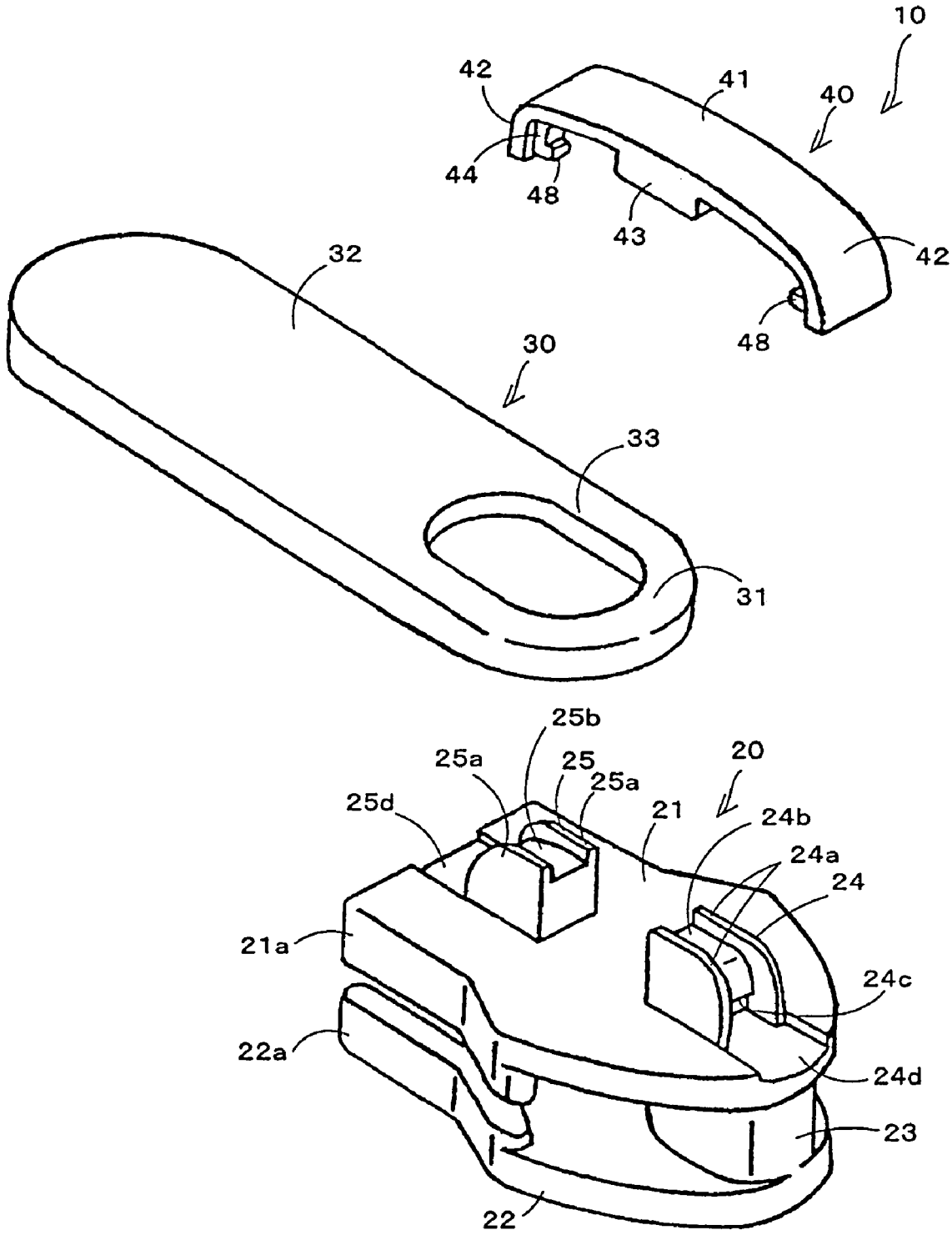
FIG. 1 is a perspective view showing a state in which parts composing a slider for a slide fastener as a typical first embodiment of the invention are separated.
Figure 2:
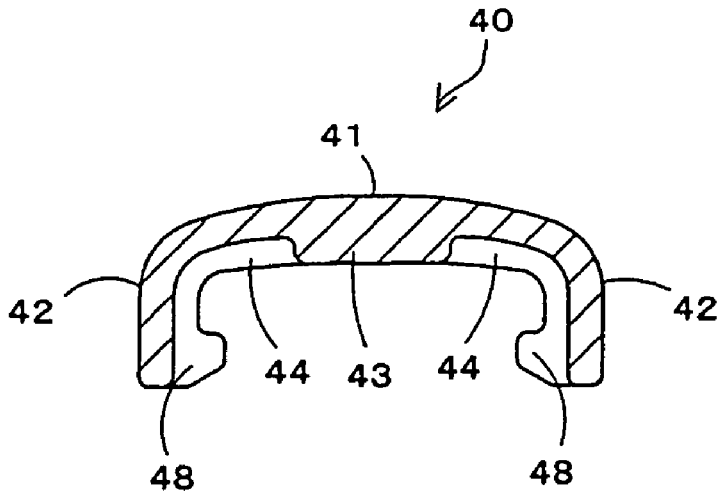
FIG. 2 is a longitudinal sectional view showing a pull holding body composing a part of the slider.
Figure 3:
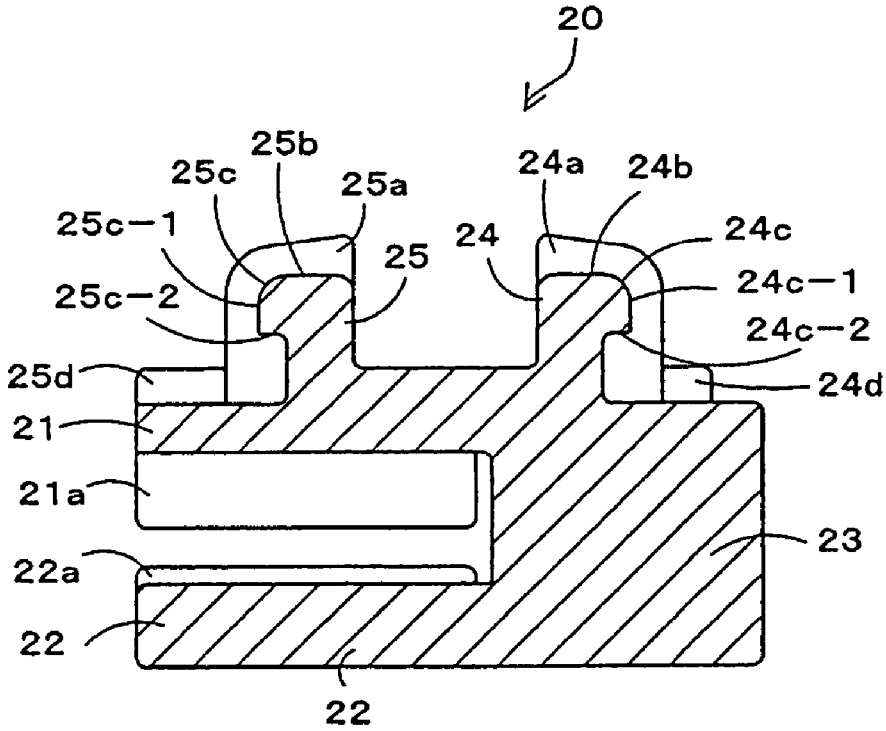
FIG. 3 is a longitudinal sectional view showing a slider body.
Figure 4:
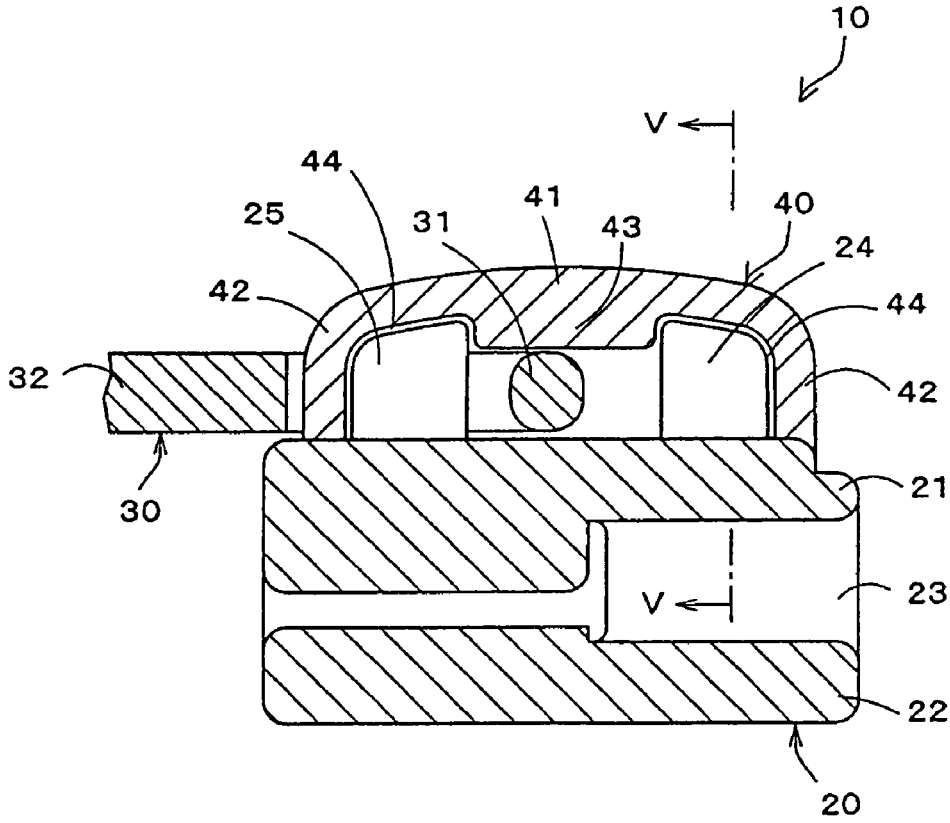
FIG. 4 is a longitudinal sectional view showing an inner structure example of the assembled slider.
Figure 5:
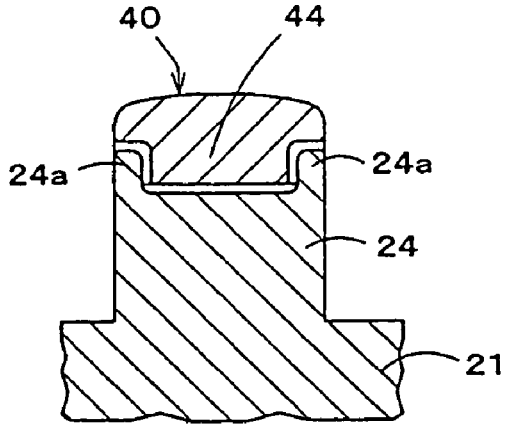
FIG. 5 is an enlarged cross sectional view taken along the line V—V in FIG. 4.
Figure 6:
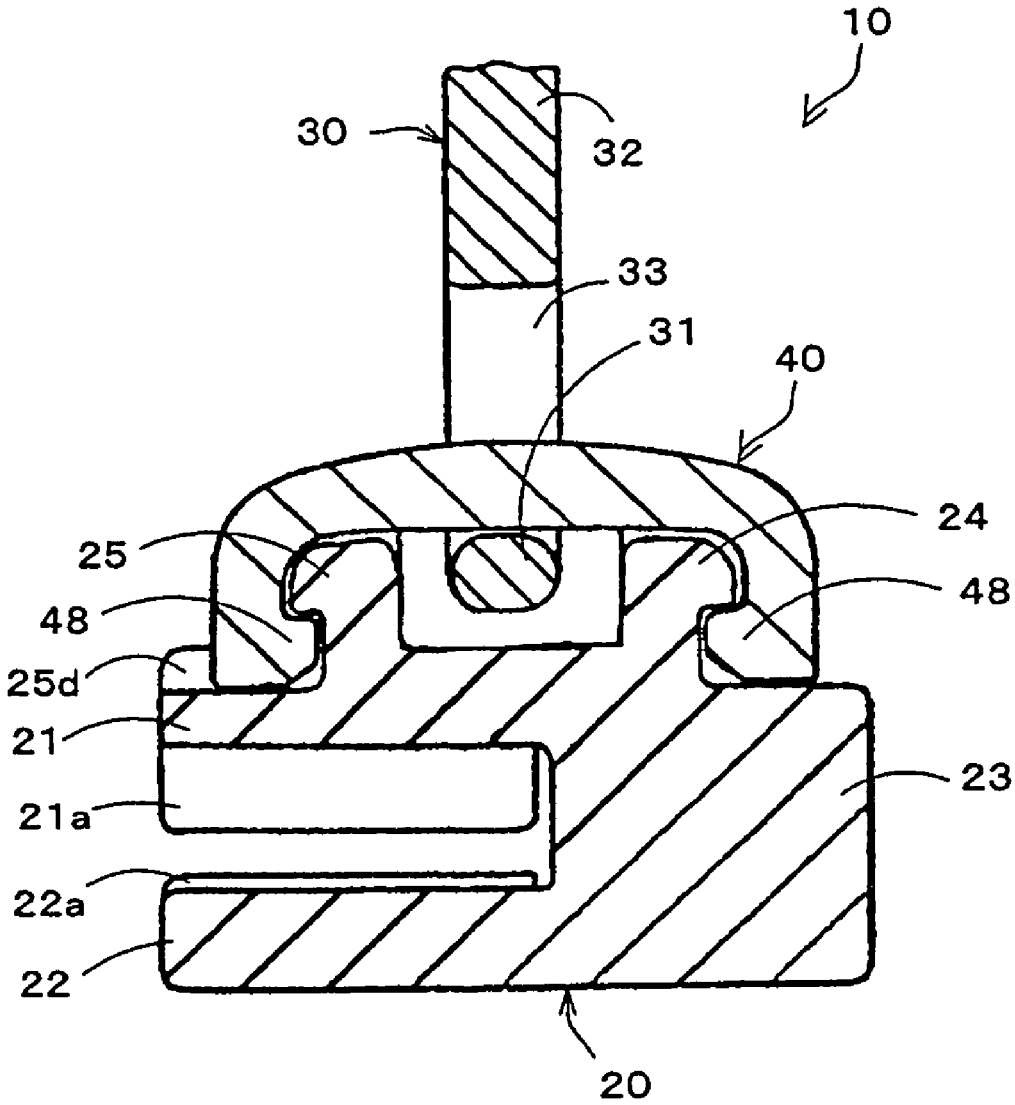
FIG. 6 is an explanatory view showing an operation state of a pull composing a part of the slider.

FIGS. 1 to 6 illustrate a typical first embodiment according to the invention. FIG. 1 is a perspective view showing a state in which parts composing the slider for a slide fastener are separated, FIG. 2 is a longitudinal sectional view showing a pull holding body composing a part of the slider, FIG. 3 is a longitudinal sectional view showing a slider body, FIG. 4 is a longitudinal sectional view showing an inner structure example of the assembled slider, FIG. 5 is an enlarged cross sectional view taken along the line V—V in FIG. 4, and FIG. 6 is an explanatory view showing an operation state of a pull composing a part of the slider. In the meantime, according to this embodiment, a shoulder opening side of the slider is referred to as a front portion and a rear opening side of the slider is referred to as a rear portion.

As a typical structure of a slider for a slider fastener 10 of the invention, as shown in FIG. 1, the slider 10 is composed of three members, namely, a slider body 20, a pull 30, and a pull holding body 40. The above-described three members, namely, the slider body 20, the pull 30, and the pull holding body 40 are manufactured by injection molding with a thermoplastic resin such as polyamid, polypropylene, polyacetal, or polybuthylene terephthalate, or a thermoplastic resin material having an abrasion resistance reinforcement added therein. Further, the three members of the slider body 20, the pull 30, and the pull holding body 40 can be made of a metal material such as an aluminum base alloy and a zinc alloy, respectively, in place of the resin material and they are manufactured by die cast molding.

As shown in FIG. 1 and FIG. 3, the slider body 20 has an upper blade 21, a lower blade 22, and a diamond 23 for coupling the front portions of these upper and lower blades 21 and 22. The upper and lower blades 21 and 22 have right and left upper and lower flanges 21*a* and 22*a*, respectively, from their rear ends to approximately center positions of the upper and lower blades, and a Y-shaped coupling element guide passage is formed between the upper and lower blades 21 and 22.

On the front and rear portions of the slider body 20, first and second post portions 24 and 25 for attaching the pull holding body 40 as a narrow lateral C-shaped cover body thereto are integrally formed on the upper surface of the upper blade 21 to rise thereon. There is a predetermined interval between these first and second post portions 24 and 25 so as to form a space portion sufficient to house a pivot 31 of the pull 30 and a part of the pull holding body 40. In the meantime, according to the illustrated example, the opposed faces of the first and second post portions 24 and 25 are arranged in parallel with each other, however, it is a matter of course that the opposed faces of these first and second post portions 24 and 25 may be formed as tapered faces, respectively, such that they are widen upward and are narrow downward as in the above-described Japanese Patent Application Publication (JP-B) No. 60-30201.

The first post portion 24 and the second post portion 25 shown in the drawing have the same structures both at the front and rear portions of the slider body 20. Therefore, in the present first embodiment, only the first post portion 24 at one side will be specifically described. Further, in the second post portion 25, the identical member names are provided to the substantially identical parts as those of the first post portion 24.

According to the configuration of the conventional slider, as the technology disclosed in the above-described Japanese Patent Application Publication (JP-B) No. 60-30201, the hook portions protruded on the front surface of the first post portion and the rear surface of the second post portion of the upper blade and the engaging pieces protruded on the inner surface of the front and rear side wall portions of the lateral C-shaped pull holding body are engaged and fixed, and further, the engaging pieces are interiorly fitted and fixed to the concave groove portions that are formed from the proximal ends at the sides of the hook portions of the first and second post portions to the front and rear edges of the upper blade.

Therefore, in the conventional slider, if a large tension load in a right and left direction and an oblique direction is added to the pull holding body by moving of the pull or the rotational operation as described above, a very large tractive force acting on the pull holding body in this time is concentrated on the engaging pieces of the pull holding body and the inner wall surfaces of the concave grooves of the upper blade against an elastic force of the pull holding body to restore its original state so as to act on them locally and directly. However, in the configuration of the conventional slider, the attachment strength between the engaging pieces of the pull holding body and the inner wall surfaces of the concave grooves of the upper blade is very small due to a structural cause. Therefore, it is very difficult to sufficiently acquire a holding force to the right and left direction or the oblique direction or the up and down direction of the pull holding body against the engaging pieces of the pull holding body by the inner wall surfaces of the concave grooves of the upper blade, so that it is not possible to secure the required engaging force in the engaging pieces of the pull holding body and the concave groove portions of the upper blade.

On the contrary, a main object of the invention is to prevent the lateral slip of the approximately lateral C-shaped pull holding body 40 in the right and left direction due to the tractive force in any directions by the operation of the pull 30 without bending the pull holding body 40 not only in the back and forth direction but also in the right and left direction, the oblique direction or the up and down direction.

The invention is mainly characterized by having the engaging pieces 48, 48, which are elastically engaged with the first locking portions 24*c* and 25*c* that are formed on the front surface of the first post portion 24 and the rear surface of the second post portion 25 of the slider body 20, in the inner surfaces of the front and rear end portions of the pull holding body 40, and further, having right and left movement preventing means for preventing relative movement in a right and left direction of the first and second post portions 24, 25 and the pull holding body 40. The right and left movement preventing means as a main mechanism of the slider 10 according to this first embodiment comprises first and second support walls 24*a*, 25*a* as second locking portions of the first and second post portions 24, 25; and protruding portions 44, 44 as second engaging portions of the pull holding body 40 to be fit and fixed between the support walls 24*a*, 25*a*.

A pair of first support walls 24*a* is raised at right and left end edges of the first post portion 24 at the side of the shoulder opening of the slider (the right side in FIG. 1), which support walls are separated at an interval corresponding to an outer shape of the pull holding body 40. On the opposed faces of these support walls 24*a*, a stepped portion 24*b* having a step falling from the upper end edge by a predetermined height is formed. A stepped plane of this stepped portion 24*b* forms an arch-shaped cross section having a gentle convex curved surface downward from the flat upper surface and it is formed as a mounting surface of the pull holding body 40 to contact and fix the pull holding body 40 and prevent the pull holding body 40 from further being fit between the support walls 24*a*.

On the front surface of the first post portion 24, a linear locking portion 24*c* is integrally formed extending across the opposed surfaces of the first support walls 24*a*. This locking portion 24*c* is shaped in a step having a guide inclined surface (sliding surface) 24*c*-1 smoothly inclined downward along the stepped portion 24*b* as shown in FIG. 3, and an edge portion engaging surface (an engaging stepped portion) 24*c*-2 to be engaged and disengaged to and from the pull holding body 40. A concave groove portion 24*d* extending from the proximal end of the front portion of the first post portion 24 to the front end thereof is formed on a center in the upper surface width direction of the upper blade 21.

On the other hand, a pair of second support walls 25*a*, 25*a* is raised at right and left end edges of the second post portion 25 at the side of the rear opening of the slider (the left side in FIG. 1), which support walls are set at the same measurements as the first support walls 24*a*. On the opposed faces of these support walls 25*a*, a stepped portion 25*b* is formed. On the rear surface of the second post portion 25, a locking portion 25*c* is integrally formed. This locking portion 25*c* is shaped in a step having a sliding surface 25*c*-1 and an engaging stepped portion 25*c*-2.

A concave groove portion 25*d* extending from the proximal end of the rear portion of the second post portion 25 to the rear end thereof is formed in the same direction as the front concave groove portion 24*d* of the first post portion 24. These concave portions 24*d* and 25*d* make gaps between the locking portions 24*c* and 25*c* of the first and second post portions 24 and 25, and the upper surface of the upper blade piece 21 enlarged without making the heights of the first and second post portions 24 and 25 higher more than necessity so as to make the locking portions 24*c* and 25*c* engaged with the engaging pieces 48, 48 of the pull holding body 40 easily.

The pull holding body 40, as shown in FIGS. 1 and 2, comprises a substantially lateral C-shaped cover body having front and rear wall portions 42, 42 that are smoothly curved and formed with the same curvature back and forth of an upper wall portion 41 having a smooth convex curved surface upward. At a center of a rear surface in the width direction of the pull holding body 40, a rectangular swelling portion 43 to be fitted and inserted into a space portion between the first post portion 24 and the second post portion 25 is protruded, and further, one protruding portion 44 extending from both front and rear sides of this swelling portion 43 to the front and rear ends on the same line is protruded by the same protrusion amounts as the swelling portion 43. The height of the protruding portion 44 is set as substantially same as the rising heights of the first and second support walls 24*a* and 25*a*. As shown in FIG. 5, the width of the protruding portion 44 is set smaller by the thickness of the first and second support walls 24*a* and 25*a*.

As shown in FIG. 5, an entire cross section of the protruding portion 40 is made in a substantially T-shape, and on the inner surfaces of the front and rear ends of the protruding portion 44 configuring a part of the right and left movement preventing means as the characteristic of the invention, engaging pieces 48 are protruded, respectively, to be elastically engaged and disengaged with and from the engaging stepped portions 24*c*-2, 25*c*-2 of the locking portions 24*c*, 25*c* of the post portions 24, 25. A lower surface of the front end of the engaging piece 48 is formed as an inclined surface, which is inclined upward toward the inner side. Along the stepped portions 24*b*, 25*b* between the opposed faces of the first and second support walls 24*a*, 25*a* of the first and second post portions 24 and 25, the protruding portion 44 of the pull holding body 40 can be accurately and stably guided toward the locking portions 24*c* and 25*c*, and at the same time, the engaging pieces 48 of the pull holding body 40 can be simply and accurately engaged between the opposed faces of the first and second support walls 24*a* and 25*a*.

Figure 10:
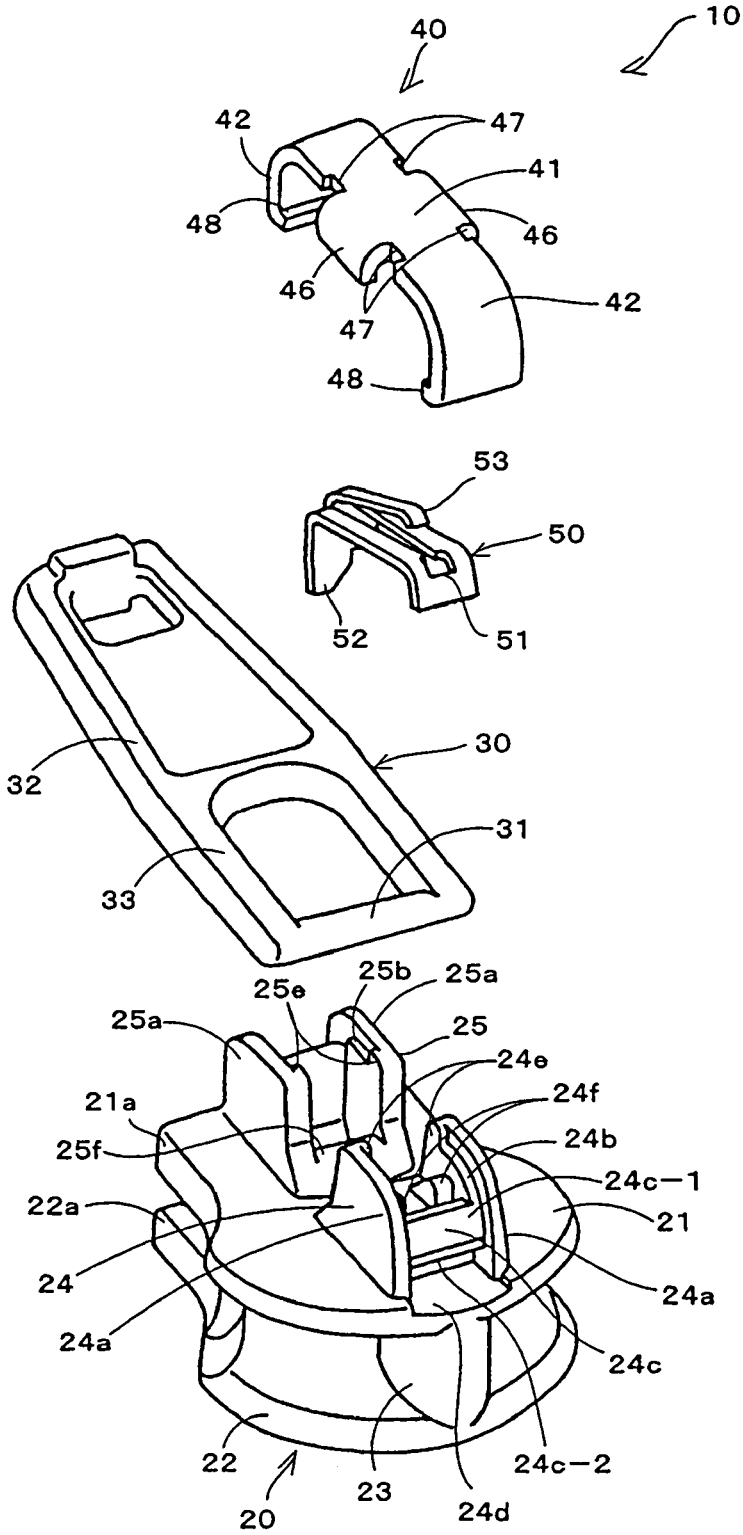
FIG. 10 is a perspective view showing a state in which parts composing a slider of a third embodiment of the invention are separated.

As shown in FIG. 1, the pull 30 comprises a long strip-shaped platy member. The pull 30 has a handle portion 32 at one end side thereof and a circular holding portion 33 having a substantially elliptical hole that is elongated in a longitudinal direction, in which the first post portion 24 or the second post portion 25 can be fitted, at other end side thereof. A front end portion of this circular holding portion 33 is formed in a bridge as the pivot 31, which is movably or rotationally disposed in a space portion formed between the first and second post portions 24 and 25. This pivot 31 is set larger than the right and left width measurements of the first and second support walls 24*a* and 25*a*. In the meantime, for example, as shown in FIG. 10, it is a matter of course that this pull 30 may have the circular handle portion 32 at its one end side and may have the circular holding portion 33 having a substantially square hole, in which the first and second post portions 24 and 25 can be fitted, at other end side thereof.

In order to assemble the slider 10 configured as described above, at first, the circular holding portion 33 of the pull 30 is inserted over the second post portion 25 of the slider body 20 so as to mount the entire pull 30 approximately horizontal posture. Then, the pull holding body 40 is fitted in the first and second post portions 24 and 25 from above the pull 30.

Fitting the protruding portions 44 of the pull holding body 40 between the first and second support walls 24*a* and 25*a* of the first and second post portions 24 and 25, in connection with fitting of the protruding portions 44, the pull holding body 40 is slid as being elastically deformed in an enlarging and opening direction on the sliding surfaces 24*c*-1 and 25*c*-1 of the locking portions 24*c* and 25*c* of the first and second post portions 24 and 25. The engaging pieces 48 of this pull holding body 40 pass through the inclined surfaces at the front ends of the sliding surfaces 24*c*-1 and 25*c*-1, and at the same time, the pull holding body 40 elastically returns in a miniaturization direction, and then, as shown in FIG. 6, the respective engaging pieces 48 are fitted in the engaging stepped portions 24*c*-2, 25*c*-2 of the locking portions 24*c*, 25*c*. Thus, assembling of the slider 10 is completed.

When the slider body 20 and the pull holding body 40 are engaged as shown in FIG. 4, a lower surface of the projecting portion 44 is mounted and supported on the stepped planes of the stepped portions 24*b* and 25*b* of the support walls 24*a* and 25*a* so as to be housed in the space portion between the support walls 24*a* and 25*a* as shown in FIG. 5. In this time, at a fitting limitation position of the pull holding body 40, the rear surface of the upper wall portion 41 and the right and left ends of the front and rear wall portions 42 are engaged with the upper ends of the support walls 24*a* and 25*a*. A lower surface of the swelling portion 43 is separated from an upper surface of the upper blade 21 to form a space portion for allowing the operation of the pivot 31 of the pull 30. A space surrounded by the lower surface of the swelling portion 43 and the upper surface of the upper blade piece 21 becomes an operational space portion to operate the pivot 31 of the pull 30.

When the slider body 20 and the pull holding body 40 are engaged with each other, the locking portions 24*c* and 25*c* of the first and second post portions 24 and 25 and the engaging pieces 48 of this pull holding body 40 are firmly fixed, movement of the pull holding body 40 in the back and forth direction is prevented, and at the same time, the opposed faces of the support walls 24*a* and 25*a* of the first and second post portions fit the right and left end portions of the pull holding body 40 and further, firmly and reliably support and fix them.

Therefore, even if a strong force to disengage engagement of the locking portions 24*c* and 25*c* of the first and second post portions 24 and 25 and the engaging pieces 48, 48 of this pull holding body 40 upon operating the pull 30 directly acts on the pull holding body 40, it is possible to increase a holding force to the right and left direction of this pull holding body 40 without bending the pull holding body 40 in the back and forth direction, the right and left direction, the oblique direction, and the up and down direction and ruggedness is improved. Accordingly, the pull holding body 40 may be formed in a substantially rectangular plate piece in a substantially simple lateral C-shaped having elasticity without necessity to be formed as a complicated structure, so that miniaturization and thinning of the slider 10 can be realized and further, the slider 10 becomes easy to treat.

Figure 7:
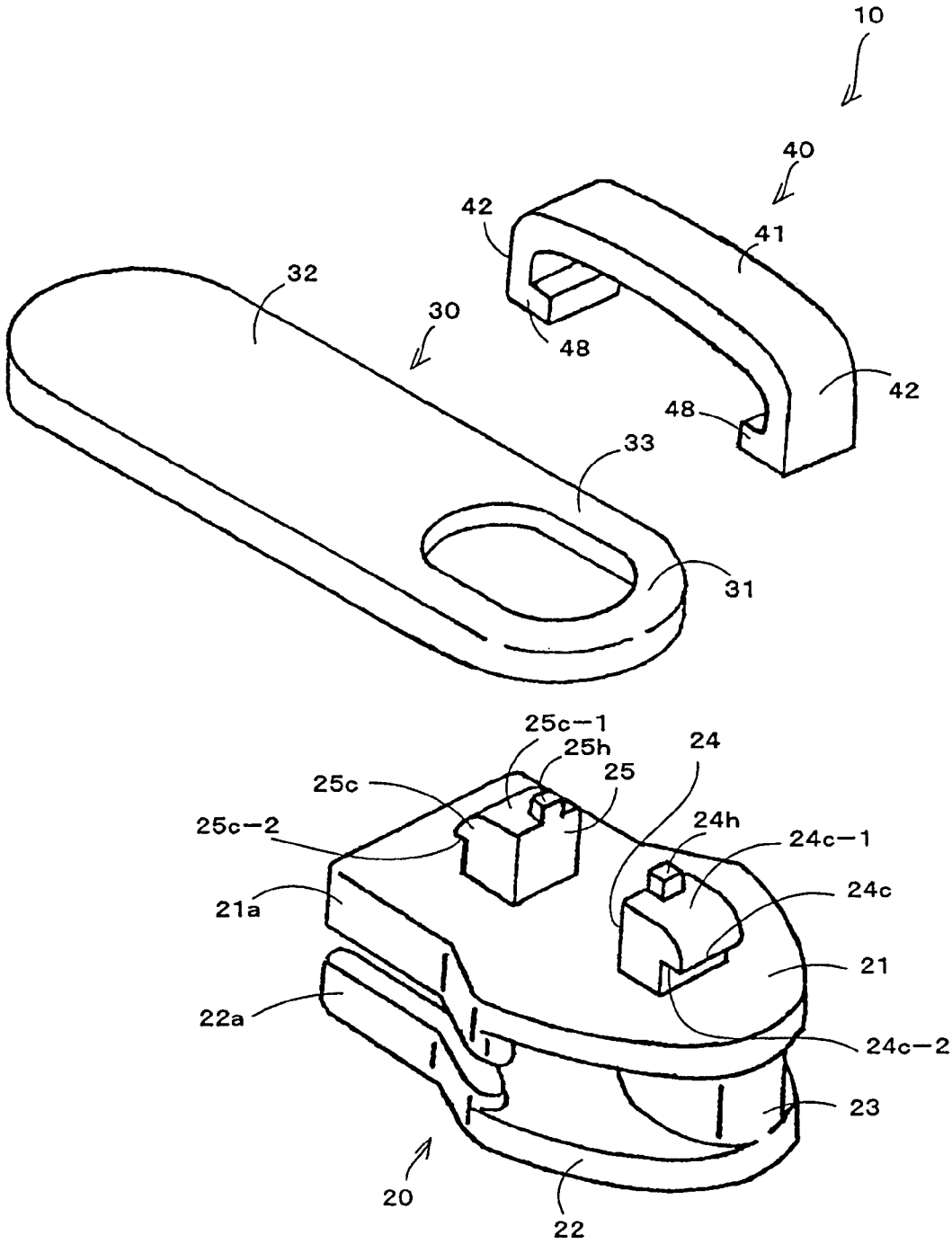
FIG. 7 is a perspective view showing a state in which parts composing a slider of a second embodiment of the invention are separated.
Figure 8:
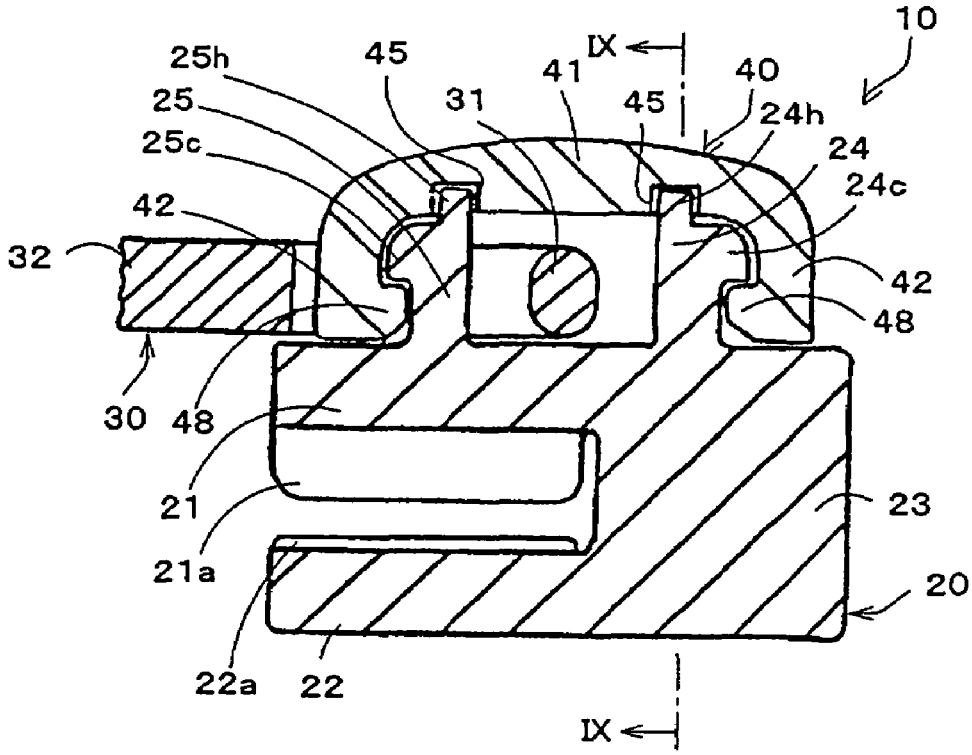
FIG. 8 is an enlarged longitudinal sectional view showing an inner structure example of the assembled slider.
Figure 9:
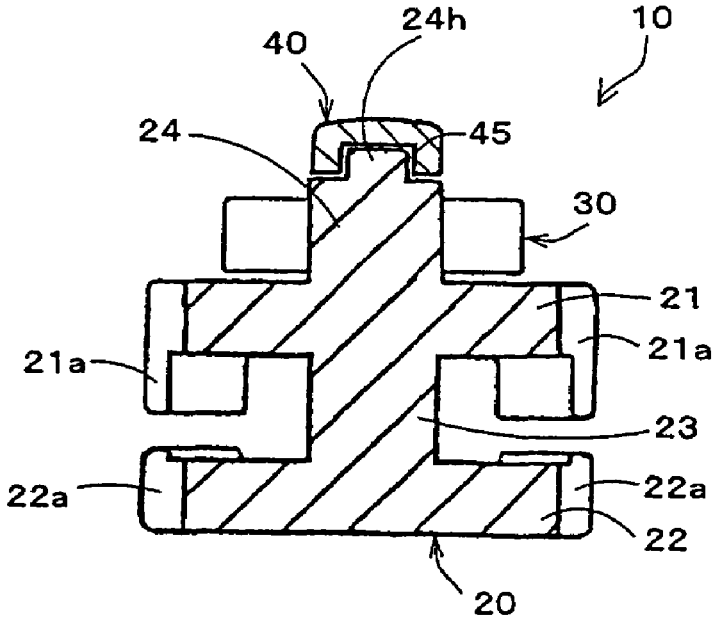
FIG. 9 is an enlarged cross sectional view taken along the line IX—IX in FIG. 8.

FIGS. 7 to 9 illustrate a second embodiment of the slider for a slide fastener 10 according to the invention. FIG. 7 is a perspective view showing a state in which parts composing this slider is separated, FIG. 8 is an enlarged longitudinal sectional view showing an inner structure example of the assembled slider, and FIG. 9 is an enlarged cross sectional view taken along the line IX—IX in FIG. 8.

This second embodiment is largely different from the first embodiment in that the support walls 24*a* and 25*a* of the first and second post portions 24 and 25 of the slider body 20 and the projecting portions 44, 44 to be fitted and fixed to the support walls 24*a* and 25*a* of the pull holding body 40 are excluded, and projecting portions 24*h* and 25*h* or concave portions 45 are provided at the upper surfaces of the first and second post portions 24 and 25 and the opposed faces of the pull holding body 40 to the respective post portions 24 and 25, such that they are fitted each other. Accordingly, in these drawings, the members that are substantially identical with the first embodiment have the identical member names and reference numerals, and the detailed explanation thereof is herein omitted.

In these drawings, even in the second embodiment, the first post portion 24 at the side of the shoulder opening of the slider and the second post portion 25 at the side of the rear opening of the slider are formed of the same structures at both front and rear portions of the slider body 20, and at the front surface of the first post portion 24 and the rear surface of the second post portions 25, the locking portions 24*c* and 25*c* are integrally formed, respectively.

The pull holding body 40 comprises a substantially lateral C-shaped cover body having the front and rear side wall portions 42, 42 which are smoothly curved and formed with the same curvature at the front and rear portions of the upper wall portion 41 having a smooth convex curved surface upward. On the inner surfaces of the front and rear end portions of the front and rear side wall portions 42, 42, engaging pieces 48, 48 elastically, engaged and disengaged to and from the locking portions 24*c*, 25*c* of the first and second post portions 24, 25 are protruded.

At respective centers of the upper surfaces of the first and second post portions 24 and 25, projecting portions 24*h* and 25*h*, which are part of the main structure of the invention, are protruded. On a rear surface of the pull holding body 40, concave portions 45, 45 each having a rectangular section to be fitted and engaged to the projecting portions 24*h* and 25*h* are formed. The right and left movement preventing means as one of the main mechanisms of the slider 10 of this second embodiment comprises the projecting portions 24*h* and 25*h* and the concave portions 45 so as to prevent the first and second post portions 24 and 25, and the pull holding body 40 from relatively moving to the right and left direction.

If such right and left movement preventing means is employed, without exposing a special fixing member at the outside of the slider body 20 and the pull holding body 40, it is possible to sufficiently secure a fixing area of the slider body 20 and the pull holding body 40, and further, by setting appropriately the projecting portions 24*h* and 25*h* and the concave portions 45 as the right and left movement preventing means at a position where the tractive force of the pull 30 may easily act, a holding force of the pull holding body 40 can be firmly acquired.

It is possible to appropriately set a figuration of this right and left movement preventing means depending on the configurations and the sizes of the pull holding body 40 and the first and second post portions 24 and 25. According to the above-described second embodiment, it is possible, for example, fitting holes are formed on the upper surfaces of the first and second post portions 24 and 25, and fitting pins to be fitted into the fitting holes are protruded on the rear surface of the pull holding body 40. It is a matter of course that these fitting holes and fitting pins may be formed in combination on the upper surfaces of the first and second post portions 24 and 25 and the rear surface of the pull holding body 40.

Figure 11:
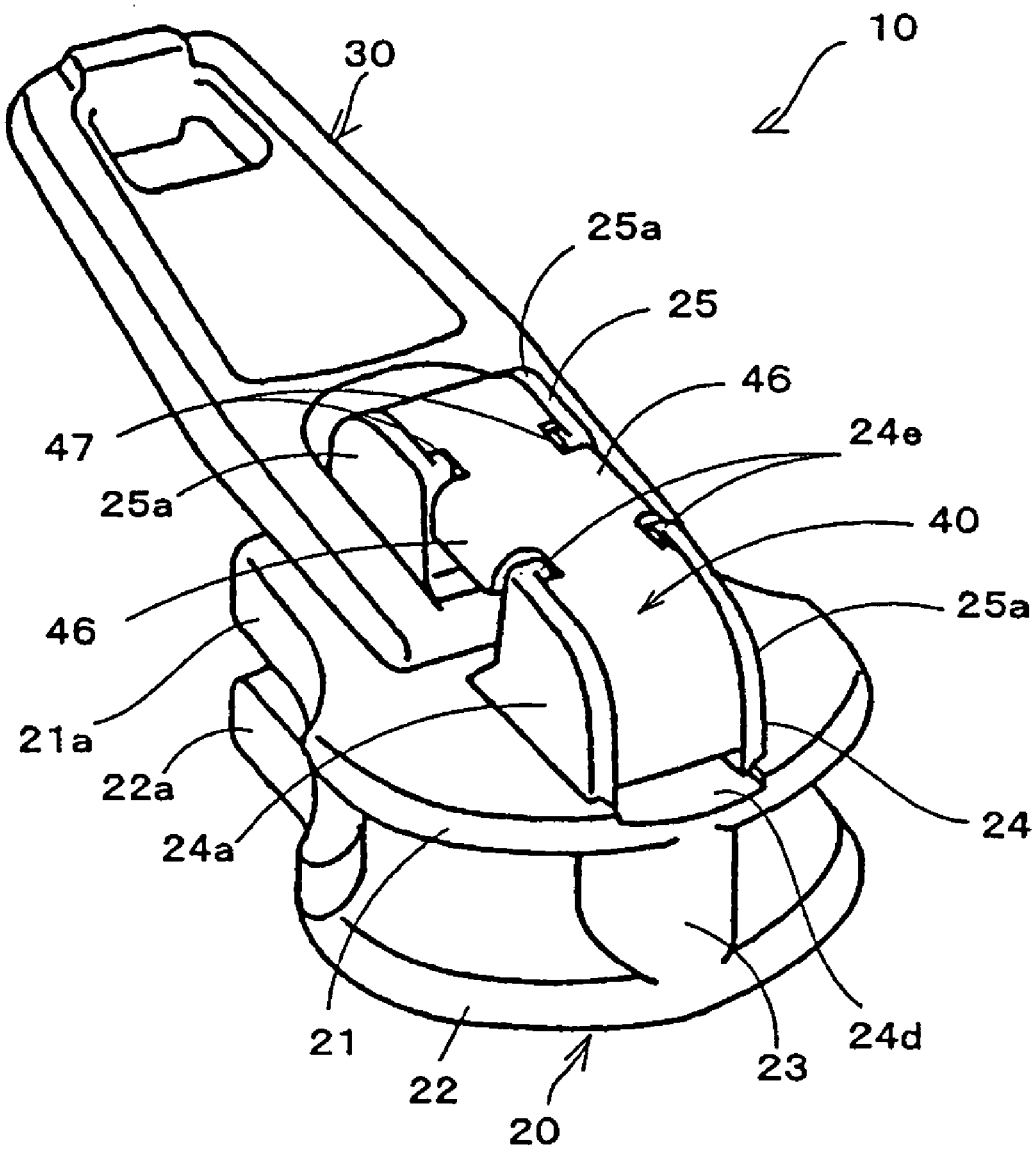
FIG. 11 is a perspective view showing the assembled slider.

FIGS. 10 and 11 illustrate a third embodiment of the slider for a slide fastener according to the present invention. FIG. 10 is a perspective view showing a state in which parts composing this slider according to the invention are separated, and FIG. 11 is a perspective view showing the assembled slider.

This third embodiment is largely different from the above respective embodiments in that right and left movement preventing means for preventing the first and second post portions 24, 25, and the pull holding body 40 from relatively moving to the right and left direction is configured by fitting and engaging the entire pull holding body 40 that is thinner than the pull holding body 40 of the above respective embodiments between the opposed surfaces of the support walls 24*a* and 25*a* of the first and second post portions 24 and 25 of the slider body 20. In the meantime, in these drawings, the substantially identical members as those of the above respective embodiments have the identical member names and reference numerals.

In these drawings, the slider 10 comprises four members, namely, the slider body 20, the pull 30, the pull holding body 40, and a spring body 50. The two members of the slider body 20 and the pull 30 are made of a metal material such as an aluminum base alloy and a zinc alloy, and they are manufactured by die cast molding. The two members of the pull holding body 40 and the spring body 50 are made of a long and elastic metal plate material such as a copper alloy and a stainless steel and it is manufactured by press work.

At right and left end edges of the first post portion 24 at the side of the shoulder opening of the slider, a pair of right and light first support walls 24*a*, 24*a* is raised as separated at an interval corresponding to an outer shape of the pull holding body 40. On the opposed faces of these support walls 24*a*, stepped portions 24*b* each having a step falling from the upper end edge by a predetermined height and leaving a small projection 24*e* at a rear end corner outside end portions are formed. Stepped planes of the stepped portions 24*b* are formed as mounting surfaces for the pull holding body 40, and on the front opposed surfaces of the support walls 24*a*, a linear locking portion 24*c* extending across the both right and left side surfaces is integrally formed.

This fastening portion 24*c* is shaped in a step having a sliding surface smoothly inclined downward along the right and left stepped portions 24*b*, and having an engaging stepped portion engaged and disengaged to and from the pull holding body 40. At respective centers of the opposed faces of the support walls 24*a* and on the upper surface of the upper blade 21, a pair of right and left platy projecting pieces 24*f*, 24*f* each having an arch-shaped cross section that is curved gently and upwardly is protruded. An upper surface of the projecting piece 24*f* is formed as a mounting surface of the spring body 50.

A pair of right and left second support walls 25*a*, 25*a* is raised at right and left end edges of the second post portions 25 at the side of a rear opening of the slider, which support walls are set at the same measurement widths as those of the first post portion 24. On the opposed faces of the support walls 25*a*, stepped portions 25*b* are formed as the mounting surfaces of the pull holding body 40 to contact and fix the pull holding body 40 and prevent the pull holding body 40 from further being fitted, with leaving the small projections 25*e* at a front end corner outside the end portions. On the opposed faces of the support walls 25*a* in the vicinity of the rear portion of the support walls, as same as the first post portion 24, the locking portion 25*c* is integrally formed.

On the opposed surfaces of the front portion of this support walls 25*a*, a linear pull guide portion 25*f* extending across its right and left both side surfaces is protruded at a position lower than the locking portion 25*c*. A pull guide surface of this pull guide portion 25*f* leads and guides the pull 30 toward a moving limitation position of the spring body 50 upon operating the pull 30. Between the locking portion 25*c* and the pull guide portion 25*f*, a rectangular pawl hole (not illustrated), in and from which a pawl portion 52 of the spring body 50 is inserted and detached, is perforated as penetrating through above and below the upper blade 21 so as to communicate with a coupling element guide passage.

The spring body 50 has a rectangular opening window portion 51 at one end of one minute platy member made of a stainless steel or the like and has the pawl portion 52 at the front end of the other end, and it is entirely formed in a lateral C-shape. This spring body 50 is provided with a flat spring piece 53 having a predetermined height, which is formed by hollowing out an outer shape of a center portion in a longitudinal direction of the minute platy member from the end portion of the main body side of the opening window portion 51 and applying a bending process in many steps.

The pull holding body 40 comprises a thin and long platy material with elasticity and a substantially lateral C-shaped cover body having the front and rear wall portions 42, 42 that are formed to be smoothly curved with the same curvature at front and rear portions of the approximately flat upper wall portion 41. On the inner surfaces of the front and rear end portions of these front and rear wall portions 42, 42, the engaging pieces 48, 48 are protruded, which are elastically engaged and disengaged with and from the engaging stepped portions 24*c*-2, 25*c*-2 of the locking portions 24*c*, 25*c* of the post portions 24, 25, respectively. The pull holding body 40 is formed to be thin so as to correspond to the rising measurement between the opposed faces of the first and second support walls 24*a* and 25*a*.

The right and left movement preventing means as one of the main mechanisms of the slider 10, according to this third embodiment, comprises the first and second support walls 24*a* and 25*a* of the first and second post portions 24 and 25; and the right and left side end edges of the pull holding body 40 which are fitted and fixed between the first and second support walls 24*a* and 25*a*. If such right and left movement preventing means is employed, the pull holding body 40 is prevented from being laterally slipped over the support walls 24*a* and 25*a* of the first and second post portions 24 and 25, and at the same time, the locking portions of the first and second post portions 24 and 25 are firmly fixed to the engaging pieces 48, 48 of the pull holding body 40, so that it is possible to prevent the pull holding body 40 from moving in any directions.

At the center portion in the longitudinal direction of the pull holding body 40, wide right and left blade pieces 46, 46 are curved downwardly with convex curved surfaces having the same curvature in their upper surfaces, the right and left blade pieces breaking and shielding a part of the space portion between the first and second post portions 24 and 25. At edge line portions (corner portions) of these right and left blade pieces 46 and the upper wall portion 41, cut-out portions 47, 47 are respectively formed to be fitted and engaged to the small projections 24*e*, 25*e* of respective post portions 24 and 25. The cut-out portion 47 is formed in a concave step from the linear both side end surfaces of the right and left blade pieces 46 toward the inside.

These right and left blade pieces 46 are set to have approximately same lengths as the measurement between the first post portion 24 and the second post portion 25, and further they are set to be shorter than the sidewall portion 42. Accordingly, when the slider body 20 and the pull holding body 40 are engaged with each other, the lower end surfaces of the right and left blade pieces 46 are separated from the upper surface of the upper blade 21 so as to form a space portion for allowing the operation of the pivot 31 of the pull 30. Upon fitting the pull holding body 40 to the upper surface of the upper blade 21 of the slider body 20, the back and forth direction and the width direction are positioned, so that the pull holding body 40 can be accurately and smoothly attached thereto.

In addition, the engaging pieces 48 of the pull holding body 40 is elastically engaged with the locking portions 24*c* and 25*c* of the post portions 24 and 25, and further, since the cut-out portions 47 of the pull holding body 40 are fitted and engaged to the small projections 24*e* and 25*e* of respective post portions 24 and 25, the pull holding body 40 can be firmly and reliably attached without being moved by any forces in the back and forth direction and the width direction, and this makes it possible to stably secure a quality of the slider 10 for a long period.

Upon assembling the slider 10 of the third embodiment configured as described above, the insertion of the pull 30 and the pull holding body 40 may be substantially the same as the first embodiment. After the pull 30 is mounted at a substantially horizontal posture, the spring body 50 is disposed from above the pivot 31 of the pull 30. In this case, the pawl portion 52 of the spring body 50 is inserted to be fitted to the pawl hole portion (not illustrated) of the second post portion 25, and an engaging portion at the opposite side of the pawl portion 52 is engaged by the projecting pieces 24*f* of the first post portion 24, which are located at a higher position than the pawl portion 52 with being mounted on the pivot 31 of the pull 30. The spring body 50 is disposed on the upper surface of the upper blade 21 with upwardly inclined from the pawl portion toward the side of the projecting pieces 24*f*, and the front end portion of a spring piece 53 is disposed above the respective post portions 24 and 25. Next, against an elastic force of the spring piece 53, the pull holding body 40 is fitted into the inside of the respective post portions 24 and 25 from above the spring body 50.

At a fitting limitation position of the pull holding body 40, the cut-out portions 47 of the pull holding body 40 are fitted in and engaged with the small projections 24*e*, 25*e* of the post portions 24 and 25, and these right and left blade pieces 46, 46 of the pull holding body 40 are fitted in a space portion between the rear surface of the first post portion 24 and the front surface of the second post portion 25 of the slider body 20. The respective post portions 24 and 25 are covered with completely housed in the inside of the pull holding body 40, and a part of the pull 30 and a part of the operation space portion where the spring body 50 is operated are sealed under the state that the lower end surfaces of the right and left blade pieces 46, 46 of the pull holding body 40 are separated from the upper surface of the upper blade 21 of the slider body 20. Consequently, the assembly of the slider 10 is completed.

Thus, since no interference of the first and second support walls 24*a* and 25*a* is given upon elastically deforming the pull holding body 40 and mounting the engaging pieces 48, the pull holding body 40 can be smoothly and simply pushed without need of the strong pushing force, and further, twist, damage and the like of the pull holding body 40 and the engaging pieces 48 are not generated. The pull holding body 40 can be formed with the bare minimum of thickness, so that the slider 10 can be miniaturized and thinned. Furthermore, the slider 10 having an excellent exterior design and a high commercial value can be obtained. In the meantime, the above-described slider configuration is not different from the conventional one substantially except for the configuration of the above-described right and left moving preventing means. Accordingly, the invention is not particularly limited to the illustrated examples and it is a matter of course that various raw materials, for example, a resin material may be used.

Figure 12:
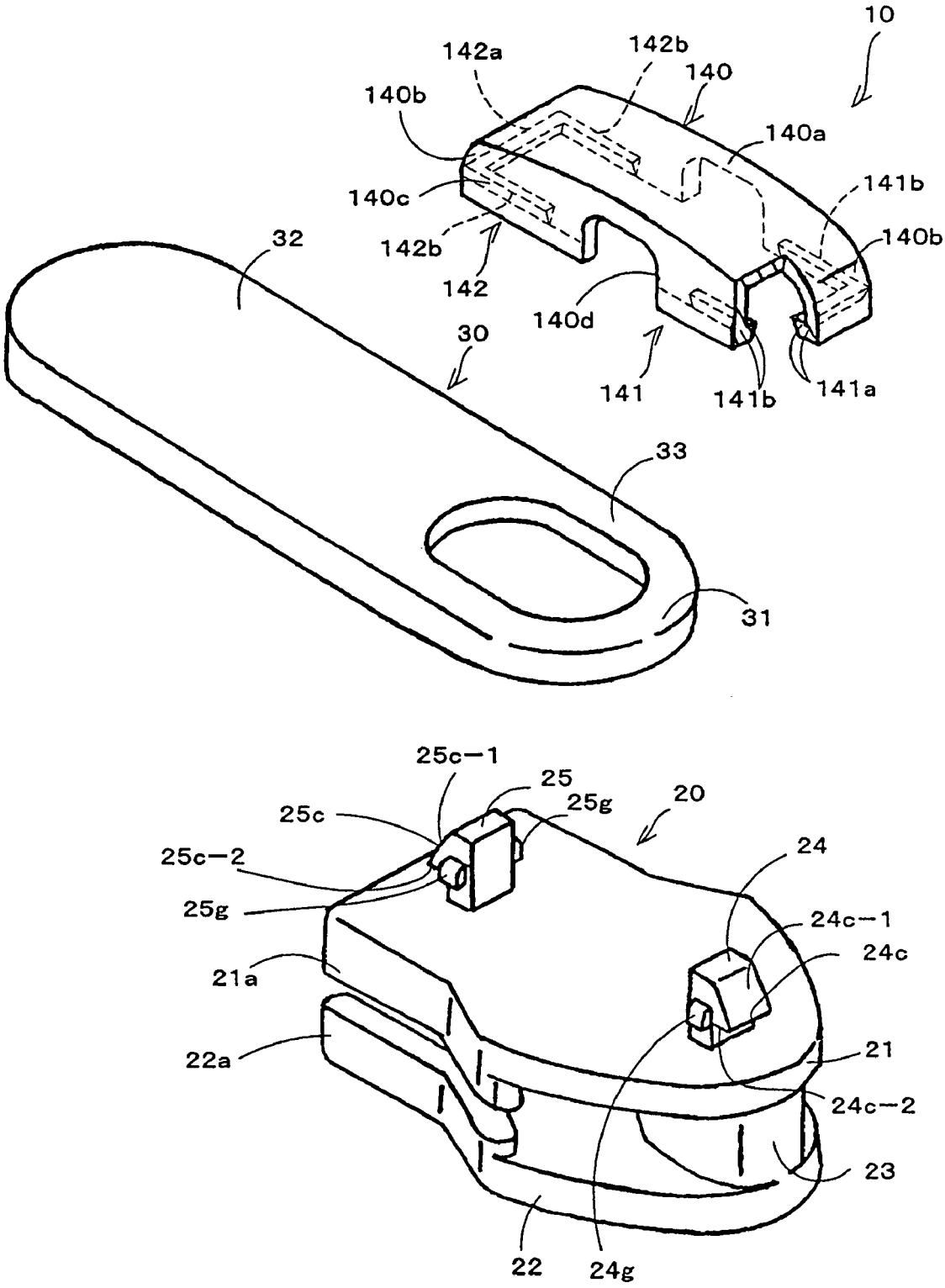
FIG. 12 is a perspective view showing a state in which parts composing a slider of a fourth embodiment of the invention are separated.
Figure 13:
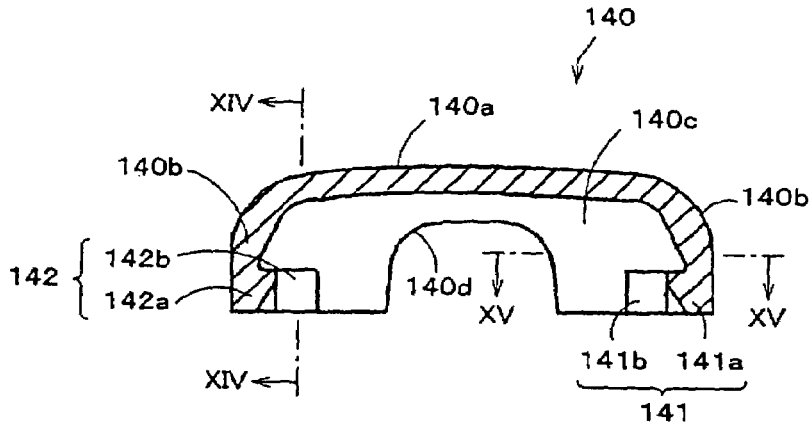
FIG. 13 is an enlarged longitudinal sectional view of a pull holding body composing a part of the slider.
Figure 14:
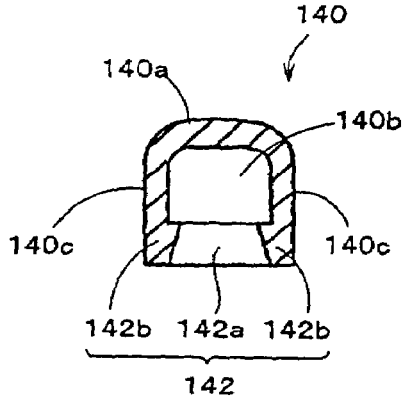
FIG. 14 is a cross sectional view taken along the line XIV—XIV in FIG. 13.
Figure 15:
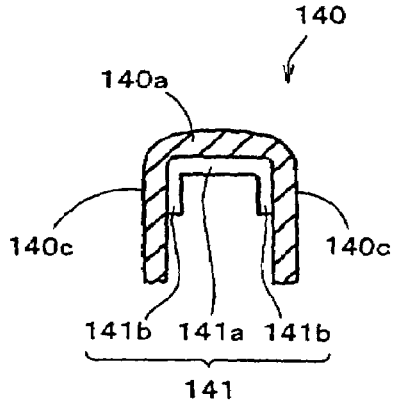
FIG. 15 is a cross sectional view taken along the line XV—XV in FIG. 13.
Figure 16:
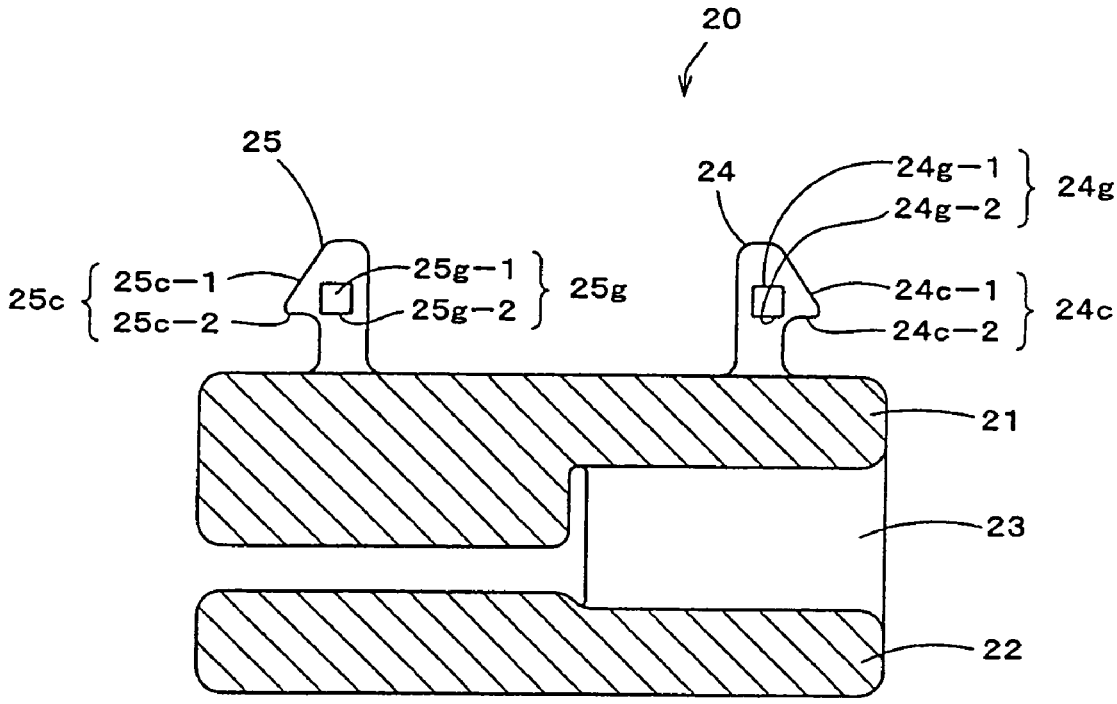
FIG. 16 is a side view showing a slider body composing a part of the slider.
Figure 17:
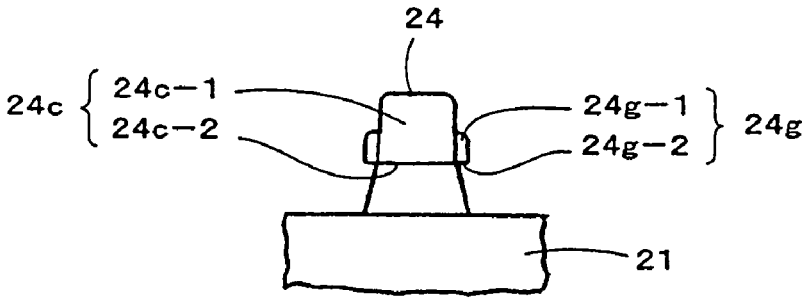
FIG. 17 is a major part front view showing a post portion of the slider body.
Figure 18:
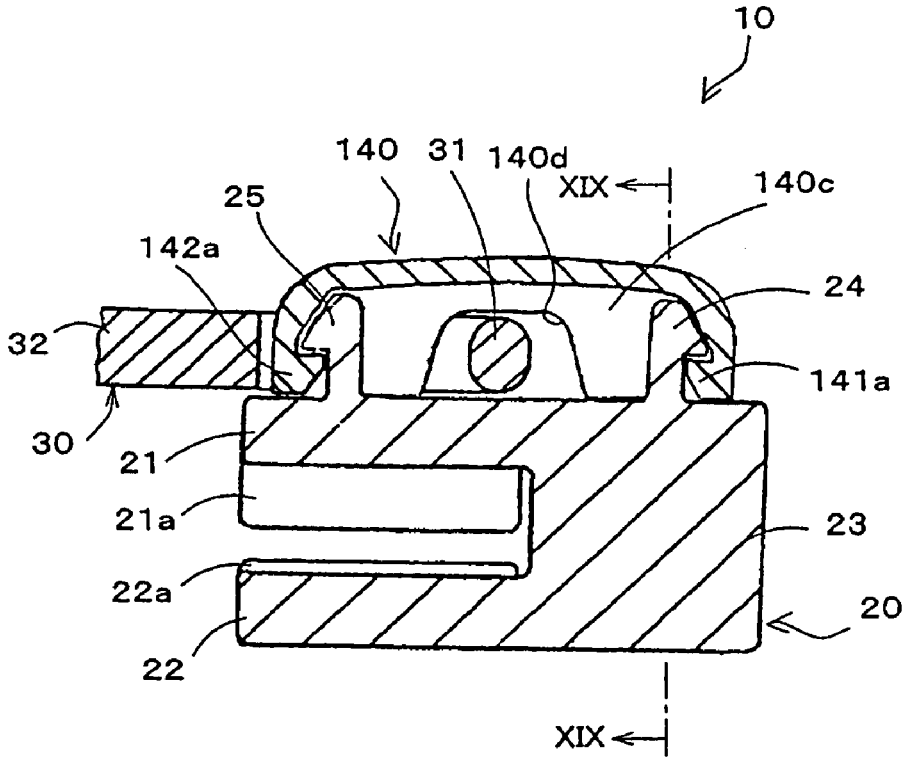
FIG. 18 is an enlarged longitudinal sectional view showing an inner structure example of the assembled slider.
Figure 19:
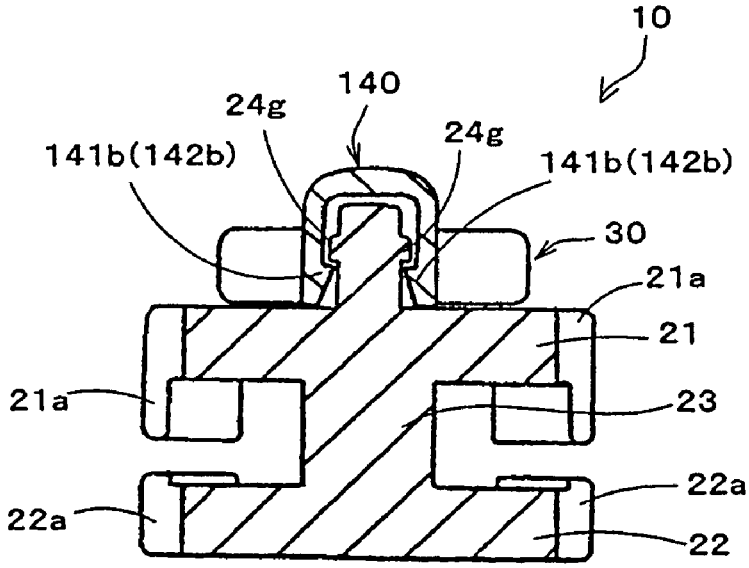
FIG. 19 is a cross sectional view taken along the line XIX—XIX in FIG. 18.

Next, with reference to FIGS. 12 to 19, a fourth embodiment of the slider according to the invention will be described below. FIG. 12 is a perspective view showing a state in which parts composing this slider is separated, FIG. 13 is an enlarged longitudinal sectional view of a pull holding body composing a part of the slider, FIG. 14 is a cross sectional view taken along the line XIV—XIV in FIG. 13, FIG. 15 is a cross sectional view taken along the line XV—XV in FIG. 13, FIG. 16 is a side view showing a slider body composing a portion of the slider, FIG. 17 is a substantial part front view showing a post portion of the slider body, FIG. 18 is an enlarged longitudinal sectional view showing an inner structure example of the assembled slider, and FIG. 19 is a cross sectional view taken along the line XIX—XIX in FIG. 18.

In these drawings, the fourth embodiment is largely different from the respective embodiments in that, in place of the platy pull holding body 40, a pull holding body 140 comprises a rectangular box with its lower surface opened is employed. In the meantime, since the substantially identical members as those of the above-described respective embodiments are given the identical member names and reference numerals in these drawings, the detailed description about these members is herein omitted.

In FIG. 12, the first and second post portions 24 and 25 of the slider body 20 are integrally molded and raised on the upper surface of the upper blade 21. Even in this fourth embodiment, both the first and second post portions 24 and 25 have the same structure at front and rear portions of the slider body 20. The pull holding body 140, as shown in FIGS. 13 to 15, has a ceiling wall portion 140*a* formed approximately flat; front and rear side wall portions 140*b*, 140*b* which are formed at front and rear portions of the ceiling wall portion 140*a* with its outer side surfaces bent in an arched-shape outwardly with the approximately same curvature; and a pair of right and left side wall portions 140*c*, 140*c* at the opposite sides for coupling the ceiling wall portion 140*a* and the front and rear side wall portions 140*b*, 140*b*.

At the positions on the lower end edges of the right and left side wall portions 140*c*, 140*c* of the pull holding body 140 corresponding to the pivot 31 of the pull 30, concave notch portions 140*d*, 140*d* are formed. A space portion surrounded by the inside of the pull holding body 140 is sufficiently spacious to operate the pivot 31 of the pull 30 thereat. When the slider body 20 and the pull holding body 140 are engaged with each other as shown in FIG. 18, the concave notch portions 140*d* are separated from the upper surface of the upper blade 21, and a space portion for allowing the operation of the pivot 31 of the pull 30 is formed.

On the inner surfaces of the lower end portions of the front and rear side wall portions 140*b*, 140*b* of the pull holding body 140, first engaging pieces 141*a* and 142*a* are integrally formed, and on the inner surfaces of the lower end portions of the right and left side wall portions 140*c*, 140*c* of the pull holding body 140, second engaging pieces 141*b* and 142*b* are integrally formed such that they intersect orthogonally to the first engaging pieces 141*a* and 142*a*. The first engaging piece 141*a* and the second engaging pieces 141*b* at the front side wall portion 140*b* of the pull holding body 140 configure the first engaging portion 141, and the first engaging piece 142*a* and the second engaging pieces 142*b* at the rear side wall portion 140*b* of the pull holding body 140 configure the second engaging portion 142. In this pull holding body 140, the first engaging portion 141 and the second engaging portion 142 have the same structure.

On the front surface of the first post portion 24 at the side of the shoulder opening of the slider and on the rear surface of the second post portion 25 at the side of the rear opening of the slider, first locking portions 24*c* and 25*c* to be engaged and disengaged with and from the first locking elements 141*a* and 142*a* of the pull holding body 140 are integrally mounted, respectively. These locking portions 24*c* and 25*c*, as shown in FIGS. 16 and 17, are shaped in a step having the sliding surfaces 24*c*-1, 25*c*-1 smoothly inclined downward, and the stepped portions 24*c*-2, 25*c*-2 to be engaged and disengaged with and from the first engaging pieces 141*a* and 142*a* of the pull holding body 140. Further, on the right and left side wall surfaces of the first and second post portions 24 and 25, second locking portions 24*g* and 25*g* are integrally formed to be engaged and disengaged with and from the second engaging pieces 141*b* and 142*b* of the pull holding body 140.

The right and left movement preventing means as one of the main mechanisms of the slider 10 according to this forth embodiment comprises the second locking portions 24*g* and 25*g* of the first and second post portions 24 and 25, and the second engaging pieces 141*b* and 142*b* of the pull holding body 140 so as to prevent the relative movement of the slider body 20 and the pull holding body 140 in the right and left direction. According to the illustrated example, at centers of the right and left side wall surfaces of the first and second post portions 24 and 25, pawl portions each having a substantially triangle cross section as the second locking portions 24*g* and 25*g* are integrally formed. These second locking portions 24*g* and 25*g* are set smaller than the first locking portions 24*c* and 25*c*.

These locking portions 24*g* and 25*g*, as shown in FIGS. 16 and 17, are shaped in a step having the sliding surfaces 24*g*-1, 25*g*-1 smoothly inclined downward in order to slide and guide the second engaging portions 141*b*, 142*b*, and the stepped portions 24*g*-2, 25*g*-2 to be engaged and disengaged with and from the second engaging pieces 141*b* and 142*b* of the pull holding body 140. The second engaging pieces 141*b*, 142*b* are protruded with a height capable of being locked by the locking portions 24*g*, 25*g*. These second engaging pieces 141*b*, 142*b* are continuously formed on the same plane of the first engaging pieces 141*a*, 142*a* so as to orthogonally intersect with the first engaging pieces 141*a*, 142*a*.

Upon assembling the slider 10 configured as described above, the insertion of the pull 30 and the pull holding body 140 is substantially identical with the above-described first embodiment. After pushing the first and second engaging pieces 141*a*, 141*b*, 142*a*, 142*b* of the pull holding body 140 into along the sliding surfaces 24*c*-1, 25*c*-1, 24*g*-1, 25*g*-1 of the first and second locking portions 24*c*, 25*c*, 24*g*, 25*g* of the first and second post portions 24 and 25 in the slider body 20, on the basis of the concave notch portions 140*d* of the pull holding body 140, the front and rear side wall portions 140*b*, 140*b* are elastically deformed in an enlarged and opened direction, and at the same time, while elastically deforming the right and left side wall portions 140*c*, 140*c* in an enlarged and opened direction, the sharp ends of the first and second engaging pieces 141*a*, 141*b*, 142*a*, 142*b* pass through the front end engaging portions of the sliding surfaces 24*c*-1, 25*c*-1, 24*g*-1, 25*g*-1. At the same time, after elastically returning the front and rear side wall portions 140*b*, 140*b* and the right and left side wall portions 140*c*, 140*c* of the pull holding body 140, the engaging stepped portions 24*c*-2, 25*c*-2, 24*g*-2, 25*g*-2 of the first and second locking portions 24*c*, 25*c*, 24*g*, 25*g*; and the first and second engaging pieces 141*a*, 141*b*, 142*a*, 142*b* are automatically engaged. In this state, the first and second engaging portions 141, 142 and the first and second locking portions 24*c*, 25*c*, 24*g*, and 25*g* are sealed with completely housed in the pull holding body 140.

In this engaged state, the pull holding body 140 and the slider body 20 can be maintained in the engagement state to prevent the back and forth movement of the pull holding body 140 by the tractive force of the pull 30, and it is possible to prevent the right and left, or the oblique, of the up and down movement of the pull holding body 140. In addition, since the first and second engaging portions 141, 142 are disposed in the inside of the pull holding body 140 across the pair of right and left concave notch portions 140*d* of the pull holding body 140, the first and second engaging portions 141, 142 are smoothly guided toward the first and second post portions 24, 25, so that it is possible to reliably and naturally engage the front end engaging surfaces of the first and second engaging pieces 141*a*, 141*b*, 142*a*, 142*b*; and the first and second locking portions 24*c*, 25*c*, 24*g*, 25*g*. As a result, it is possible to prevent damage, deformation and the like of the first and second locking portions 24*c*, 25*c*, 24*g*, 25*g*, and after attaching the pull holding body 140 to the slider body 20, it is possible to prevent twist, damage and the like of the first and second engaging portions 141 and 142.

In the meantime, according to the respective embodiments, a structural example such that the engaging pieces 48, 141*a*, 141*b*, 142*a*, and 142*b* are disposed at a part of the inner wall surfaces of the elastically-deformable pull holding bodies 40, 140 is described, however, the figurations, the setting positions, the number of elements to be set and the like of these engaging pieces 48, 141*a*, 141*b*, 142*a*, and 142*b* are not limited to the illustrated example. On the other hand, the locking portions 24*c*, 25*c*, 24*g*, 25*g* to be engaged and disengaged with and from the engaging pieces 48, 141*a*, 141*b*, 142*a*, and 142*b* are not limited to the above-described respective illustrated examples. They may be configured so as to be engaged and disengaged with and from the front end engaging portions of the engaging pieces 48, 141*a*, 141*b*, 142*a*, and 142*b*, and the structures, the figures and the like of the locking portions 24*c*, 25*c*, 24*g*, 25*g* are not particularly limited. As the locking portions 24*c*, 25*c*, 24*g*, 25*g*, for example, various structures having the convex portion, the concave portion, the hole, the notch and the like may be employed.

In addition, the engaging pieces 48, 141*a*, 141*b*, 142*a*, and 142*b* may be elastic engaging pieces that are elastically deformed when they are mounted on the pull holding body. In this case, the insertion operation of the pull holding bodies 40, 140 can be smoothly and simply carried out by a small pushing force while preventing lateral slip of the pull holding bodies 40, 140 by a multifunction with the right and left movement preventing means, and it is possible to naturally and reliably engage the elastic engaging pieces and the locking portions 24*c*, 25*c*, 24*g*, 25*g* with each other.

The preferred embodiments according to the invention are as described above, and for example, as the right and left movement preventing means, according to the above-described embodiments, a structural example is described, wherein, the protruding portion 44, the concave portion 45 or the engaging pieces 141, 142 are disposed on a part of the wall surfaces of the pull holding bodies 40, 140, and further, the support walls 24*a*, 25*a*, the projecting portions 24*h* and 25*h*, and the locking portions 24*g*, 25*g*, which are engaged with the protruding portions 44, the concave portion 45 or the engaging pieces 141 and 142, are disposed on a part of the wall surfaces of the post portions 24, 25. However, in relation to other causes such as the figuration and the size of the slider body 20 and the pull holding bodies 40, 141, any one of the right and left movement preventing means or arbitrary combinations thereof can sufficiently attain the object of the invention.

In the meantime, according to the invention, the figurations of the pull holding bodies 40, 141 are not particularly limited, and as the figurations of the pull holding bodies 40, 141, for example, the upper wall portion 41 of the pull holding body 40 may be a flat wall surface, and the ceiling wall portion 140*b* of the pull holding body 140 may be a convex wall surface that is smoothly curved upward. In addition, with respect to the upper wall portion 41 and the ceiling wall portion 140*b*, the front side wall portion among the front and rear side wall portions may be set higher than the rear side wall portion, and on the contrary, the rear side wall portion may be set higher than the front side wall portion. Accordingly, it is a matter of course that the invention is not limited to the above-described embodiments and the modified example, and the invention can be variously modified within the scope of the invention.

What is claimed is:

1. A slider for a slide fastener comprising a slider body having upper and lower blades, of which front ends are coupled by a diamond at a predetermined interval; a pull; and a pull holding body for movably holding the pull between the pull holding body and an upper surface of the slider body, wherein first and second post portions are disposed at front and rear portions of an upper surface of the upper blade, and locking portions are disposed on a front surface of the first post portion and a rear surface of the second post portion;

the pull holding body is composed of a plate-shaped cover body having an upper wall portion and front and rear side wall portions, and engaging portions to be elastically engaged with the locking portions of the first and second post portions are disposed on front and rear inner surfaces of the front and rear side wall portions;

the first and second post portions and the pull holding body further have right and left movement preventing means for preventing relative movement in a right and left direction by a fit or an engagement between the first and second post portions and the pull holding body;

the right and left movement preventing means is support walls that are raised at right and left end edges of the first and second post portions;

the engaging portions of the pull holding body are composed of engaging pieces to be engaged with the locking portions of the first and second post portions, and the locking portions have sliding surfaces to slide and guide the engaging pieces and to elastically deform them and have engaging stepped portions to be engaged with the engaging pieces;

opposed faces of a pair of right and left support walls of the first and second post portions have stepped portions to mount and support right and left side edge portions of the pull holding body and stepped surfaces of the stepped portions of the support walls are formed along the sliding surfaces of the locking portions of the first and second post portions; and the pull holding body is fitted and supported between the right and left support walls.

2. The slider for the slide fastener according to claim 1, wherein the right and left movement preventing means is formed on upper surfaces of the first and second post portions, and opposed faces of the pull holding body against the post portions, respectively, as projecting portions and concave portions that are fitted to each other.

3. The slider for the slide fastener according to claim 1, wherein right and left blade pieces each having a width between the first and second post portions are disposed on a center portion in a longitudinal direction of a main body of the pull holding body.

4. The slider for the slide fastener according to claim 3, wherein cut-out portions are formed on a part of the main body, the part being adjacent to proximal end portions at elongation sides of the right and left blade pieces, and small projections to be fitted in the cut-out portions are formed at the outside end portions of stepped portions of the first and second post portions.

* * * * *